US009106364B1

(12) United States Patent
Singleton et al.

(10) Patent No.: US 9,106,364 B1
(45) Date of Patent: Aug. 11, 2015

(54) SIGNAL PROCESSING OF A HIGH CAPACITY WAVEFORM

(75) Inventors: Mark Singleton, Glendale, AZ (US); Douglas Macauley, Germantown, MD (US); David Rampersad, Frederick, MD (US); Wen-Chun Ting, Germantown, MD (US)

(73) Assignee: COMTECH MOBILE DATACOM CORPORATION, Germantown, MD (US)

( * ) Notice: Subject to any disclaimer, the term of this patent is extended or adjusted under 35 U.S.C. 154(b) by 667 days.

(21) Appl. No.: 12/693,116

(22) Filed: Jan. 25, 2010

Related U.S. Application Data

(60) Provisional application No. 61/202,061, filed on Jan. 26, 2009, provisional application No. 61/183,391, filed on Jun. 2, 2009.

(51) Int. Cl.
*H04K 1/00* (2006.01)

(52) U.S. Cl.
CPC ..... *H04K 1/00* (2013.01)

(58) Field of Classification Search
CPC ..... H03M 13/19; H03M 13/1102; H03M 13/3761; H04K 1/00
USPC ..... 380/270
See application file for complete search history.

(56) References Cited

U.S. PATENT DOCUMENTS 4,486,739 A 12/1984 Franaszek et al.
4,649,396 A 3/1987 Friedman
4,876,737 A 10/1989 Woodworth et al.
4,901,307 A 2/1990 Gilhousen et al.
5,109,390 A 4/1992 Gilhousen et al.
5,309,474 A 5/1994 Gilhousen et al.
5,376,778 A 12/1994 Kreft
5,490,165 A 2/1996 Blakeney, II et al.
5,537,397 A 7/1996 Abramson (Continued)

FOREIGN PATENT DOCUMENTS

DE 102004016548 A1 10/2005
EP 1406207 A1 4/2004

OTHER PUBLICATIONS

HT PHY Specification. Enhanced Wireless Consortium publication. V1.27. Dec. 23, 2005. http://www.engr.sjsu.edu/rmorelos/ee252s07/EWC_PHY_spec_V127.pdf.*

(Continued)

*Primary Examiner* — Tamara T Kyle
(74) *Attorney, Agent, or Firm* — Morgan, Lewis & Bockius LLP

(57) ABSTRACT

The invention broadly encompasses a signal processor of a High Capacity Waveform (HCW) that includes a method and system for generating the HCW, the method comprising the steps of receiving an encrypted source data packet and modulating a received encrypted source data signal representing the packet, wherein the modulating step further comprises the steps of encoding with high level data link control, scrambling the modulated signal, wherein the scrambling comprises applying digital logic, and encoding the scrambled signal, wherein the encoding comprises using a variable rate low density parity check (LDPC) code for forward error correction (FEC).

13 Claims, 19 Drawing Sheets

(56) References Cited

U.S. PATENT DOCUMENTS 5,559,790 A 9/1996 Yano et al.
5,566,168 A 10/1996 Dent
5,568,472 A 10/1996 Umeda et al.
5,570,350 A 10/1996 Myer et al.
5,594,454 A 1/1997 Devereux et al.
5,612,949 A 3/1997 Bennett
5,625,629 A 4/1997 Wenk
5,640,166 A 6/1997 Siwiak
5,668,556 A 9/1997 Rouffet et al.
5,694,396 A 12/1997 Firouzbakht et al.
5,697,050 A 12/1997 Wiedeman
5,724,384 A 3/1998 Kim et al.
5,758,260 A 5/1998 Wiedeman
5,790,070 A 8/1998 Natarajan et al.
5,796,777 A 8/1998 Terlep et al.
5,815,071 A 9/1998 Doyle
5,818,883 A 10/1998 Smith et al.
5,835,069 A 11/1998 Skoog
5,841,765 A 11/1998 Fielding et al.
5,872,777 A 2/1999 Brailean et al.
5,920,278 A 7/1999 Tyler et al.
5,983,111 A 11/1999 Kim
5,999,561 A 12/1999 Naden et al.
6,052,561 A 4/2000 Rudowicz et al.
6,084,919 A 7/2000 Kleider et al.
6,088,413 A 7/2000 Autry et al.
6,100,806 A 8/2000 Gaukel
6,121,922 A 9/2000 Mohan
6,128,276 A 10/2000 Agee
6,128,469 A 10/2000 Zenick, Jr. et al.
6,151,313 A 11/2000 Abramson
6,163,681 A 12/2000 Wright et al.
6,185,245 B1 2/2001 Kim
6,188,682 B1 2/2001 Takagi et al.
6,205,167 B1 3/2001 Kamgar et al.
6,226,531 B1 * 5/2001 Holt et al. ..... 455/562.1
6,301,316 B1 10/2001 Uchida et al.
6,307,840 B1 10/2001 Wheatley, III et al.
6,317,029 B1 11/2001 Fleeter
6,339,611 B1 1/2002 Antonio et al.
6,349,110 B1 2/2002 Davidovici et al.
6,353,730 B1 3/2002 Buettner et al.
D455,641 S 4/2002 Trifilio
6,373,831 B1 4/2002 Secord et al.
6,396,819 B1 5/2002 Fleeter et al.
6,421,373 B1 7/2002 Saito
6,438,118 B1 8/2002 Matui
6,507,602 B1 1/2003 Dent
6,510,172 B1 1/2003 Miller
6,529,488 B1 3/2003 Urs et al.
6,549,559 B2 4/2003 Kamgar et al.
6,574,205 B1 6/2003 Sato
6,628,699 B2 9/2003 Ramberg et al.
6,639,906 B1 10/2003 Levin
6,683,605 B1 1/2004 Bi et al.
6,720,801 B2 4/2004 Houlberg
6,728,298 B1 4/2004 Okubo et al.
6,754,190 B2 6/2004 Gurney et al.
6,763,056 B1 7/2004 Ohsuge
6,768,729 B1 7/2004 Ohsuge
6,799,094 B1 9/2004 Vaida et al.
6,826,169 B1 11/2004 Nagatani et al.
6,876,645 B1 4/2005 Guey et al.
6,894,995 B2 5/2005 Chitrapu et al.
6,944,149 B1 9/2005 Kim et al.
6,985,512 B1 1/2006 McDermott et al.
7,006,032 B2 2/2006 King et al.
7,053,767 B2 5/2006 Petite et al.
7,110,435 B1 9/2006 Sorrells et al.
7,131,136 B2 10/2006 Monroe
7,203,630 B2 4/2007 Kolb et al.
7,227,884 B2 6/2007 McDermott
7,236,778 B2 6/2007 Schreiber
D554,474 S 11/2007 Miller
7,394,870 B2 7/2008 Chien et al.
D574,221 S 8/2008 Allen
7,430,257 B1 9/2008 Shattil
7,433,391 B2 10/2008 Stafford et al.
D582,918 S 12/2008 Scott
7,592,953 B2 9/2009 Morana
7,706,748 B2 4/2010 Dutta
7,848,458 B2 12/2010 Ochiai et al.
7,876,259 B2 1/2011 Schuchman
8,054,866 B2 11/2011 Sasaoka et al.
2002/0024965 A1 2/2002 Lee
2002/0067759 A1 6/2002 Ertel et al.
2002/0089434 A1 7/2002 Ghazarian
2002/0097690 A1 7/2002 Fleeter et al.
2002/0173888 A1 11/2002 Shelton et al.
2002/0177476 A1 11/2002 Chou
2002/0191632 A1 12/2002 McDermott
2003/0053521 A1 3/2003 Huang et al.
2003/0063576 A1 4/2003 DiFazio
2003/0123384 A1 7/2003 Agee
2003/0161428 A1 8/2003 Garrett et al.
2003/0202485 A1 10/2003 Mansfield
2003/0204378 A1 10/2003 Cai
2003/0235148 A1 12/2003 Yang
2004/0001534 A1 1/2004 Yang
2004/0008253 A1 1/2004 Monroe
2004/0029579 A1 2/2004 Kashiwase
2004/0029615 A1 2/2004 Gerry et al.
2004/0059531 A1 3/2004 Tomida et al.
2004/0117611 A1 6/2004 Huber et al.
2004/0121729 A1 6/2004 Herndon et al.
2004/0183673 A1 9/2004 Nageli
2004/0246104 A1 12/2004 Baechtiger et al.
2005/0038601 A1 2/2005 Dentinger et al.
2005/0041573 A1 2/2005 Eom et al.
2005/0060339 A1 3/2005 McGee
2005/0076034 A1 4/2005 Addonisio et al.
2005/0143005 A1 6/2005 Moore, III
2005/0175123 A1 8/2005 Gurney et al.
2005/0176436 A1 8/2005 Mantravadi et al.
2005/0201311 A1 9/2005 Willey et al.
2005/0201326 A1 9/2005 Lakkis
2005/0248456 A1 11/2005 Britton, Jr. et al.
2005/0281319 A1 12/2005 Schilling
2006/0055561 A1 3/2006 Kamali et al.
2006/0094450 A1 5/2006 Park et al.
2006/0140314 A1 6/2006 Kim et al.
2006/0141930 A1 6/2006 Keen et al.
2006/0187026 A1 8/2006 Kochis
2006/0233147 A1 10/2006 Karabinis
2006/0251107 A1 11/2006 Geren et al.
2007/0031150 A1 2/2007 Fisher et al.
2007/0040647 A1 2/2007 Saenz et al.
2007/0064641 A1 3/2007 Laroia et al.
2007/0086335 A1 4/2007 McCanne et al.
2007/0116158 A1 5/2007 Guo et al.
2007/0117515 A1 5/2007 Sinibaldi et al.
2007/0130599 A1 6/2007 Monroe
2007/0202816 A1 8/2007 Zheng
2007/0223425 A1 9/2007 Masui et al.
2007/0291826 A1 12/2007 Hafuka
2007/0293149 A1 12/2007 Wubker
2007/0298786 A1 12/2007 Meyers et al.
2008/0030345 A1 2/2008 Austin et al.
2008/0043653 A1 2/2008 Lakkis
2008/0181170 A1 7/2008 Branlund et al.
2009/0042516 A1 2/2009 Karabinis
2009/0046771 A1 * 2/2009 Abe et al. ..... 375/228
2009/0135954 A1 5/2009 Salhov et al.
2009/0175299 A1 7/2009 Hosokawa et al.
2009/0238246 A1 9/2009 Dawid et al.
2009/0257517 A1 10/2009 Nordstrom et al.
2009/0279620 A1 11/2009 Schenk
2009/0298422 A1 12/2009 Conroy et al.
2009/0316759 A1 12/2009 Zeira
2010/0064091 A1 3/2010 Futenma et al.

(56) References Cited

U.S. PATENT DOCUMENTS

| | | | | |
|---|---|---|---|---|
| 2010/0166180 | A1* | 7/2010 | Steer et al. | 380/252 |
| 2010/0322334 | A1 | 12/2010 | Wang et al. | |
| 2011/0038261 | A1 | 2/2011 | Carlstrom | |

OTHER PUBLICATIONS

DVB User Guidelines for the second generation system for Broadcasting, INteractive Services, News Gather ing and other broadband satellite applications (DVB-S2). ETSI TR 102 376 v.1.1.1 Technical Report. 2005. http://www.etsi.org/deliver/etsi_tr/102300_102399/102376/01.01.01_60/tr_102376v010101p.pdf.*
Candell, Office Action, U.S. Appl. No. 12/692,789, Mar. 30, 2012, 8 pgs.
Larson, Space Mission Analysis and Design, Second Edition, Chapter 22, Design of Low-Cost Spacecraft, pp. 767-796.
McDermott, Specification and Drawings, U.S. Appl. No. 11/876,747, Oct. 22, 2007, 28 pgs.
Berthet, Synchronization Complexity for a Satellite Multimedia Burst Receiver, [date], 5 pgs.
Evans, Satellite Communication Systems 3rd edition, Jan. 2009, cover page and p. 468.
Fleeter, Notice of Allowance and Fees Due, U.S. Appl. No. 10/054,175, Aug. 18, 2004, 7 pgs.
Fleeter, Office Action, U.S. Appl. No. 09/130,854, Nov. 22, 2000, 7 pgs.
Fleeter, Office Action, U.S. Appl. No. 10/992,173, Apr. 8, 2011, 14 pgs.
Fleeter, Final Office Action, U.S. Appl. No. 10/992,173, Oct. 12, 2011, 15 pgs.
Franke, Choosing the best hardware form-factor for the airborne domain of the Joint Tactical Terminal (JTT) and Joint Tactical Radio System (JTRS), Aug. 6, 2002, 8 pgs.
Handermann, Notice of Allowance and Fees Due, U.S. Appl. No. 11/685,936, Dec. 1, 2009, 6 pgs.
Handermann, Office Action, U.S. Appl. No. 11/685,936, Sep. 9, 2009, 22 pgs.
Handermann, Office Action, U.S. Appl. No. 11/685,936, Oct. 20, 2008, 16 pgs.
Handermann, Supplemental Notice of Allowability, U.S. Appl. No. 11/685,936, Dec. 15, 2009, 4 pgs.
Harms, The Orbcomm Experience, EMPS 2004, Sep. 2004, 6 pgs.
Holm, Why convert to a SAASM-based Global Positioning System?, Military Embedded Systems, Oct. 2005, 3 pgs.
International Search Report and Written Opinion, PCT/US2006/042524, Apr. 22, 2008, 13 pgs.
International Search Report and Written Opinion, PCT/US2006/049656, Feb. 21, 2008, 12 pgs.
International Search Report and Written Opinion, PCT/US2007/063986, Oct. 26, 2007, 12 pgs.
Jordan, Final Office Action, U.S. Appl. No. 11/936,784, Nov. 7, 2011, 16 pgs.
Jordan, Office Action, U.S. Appl. No. 11/936,784, Aug. 27, 2010, 12 pgs.
McDermott, Notice of Allowance and Fees Due, U.S. Appl. No. 11/739,377, Dec. 14, 2011, 7 pgs.
McDermott, Notice of Allowance and Fees Due, U.S. Appl. No. 09/513,962, Sep. 9, 2005, 4 pgs.
McDermott, Notice of Allowance and Fees Due, U.S. Appl. No. 10/208,882, Apr. 10, 2007, 8 pgs.
McDermott, Notice of Allowance and Fees Due, U.S. Appl. No. 11/876,747, Jun. 3, 2009, 7 pgs.
McDermott, Office Action, U.S. Appl. No. 09/513,962, Sep. 14, 2004, 6 pgs.
McDermott, Final Office Action, U.S. Appl. No. 09/513,962, Apr. 16, 2004, 10 pgs.
McDermott, Office Action, U.S. Appl. No. 09/513,962, Jun. 24, 2003, 10 pgs.
McDermott, Final Office Action, U.S. Appl. No. 09/513,962, May 27, 2005, 9 pgs.
McDermott, Office Action, U.S. Appl. No. 11/739,377, Aug. 23, 2011, 17 pgs.
McDermott, Office Action, U.S. Appl. No. 11/876,747, Nov. 28, 2008, 5 pgs.
McDermott, Office Action, U.S. Appl. No. 10/208,882, Jan. 3, 2007, 11 pgs.
Meyers, Notice of Allowance and Fees Due, U.S. Appl. No. 11/592,008, Aug. 26, 2010, 10 pgs.
Meyers, Office Action, U.S. Appl. No. 11/592,008, Feb. 3, 2010, 24 pgs.
Meyers, Office Action, U.S. Appl. No. 11/592,008, Aug. 15, 2008, 18 pgs.
Meyers, Office Action, U.S. Appl. No. 11/592,008, May 18, 2010, 25 pgs.
Meyers, Office Action, U.S. Appl. No. 11/592,008, Mar. 19, 2009, 25 pgs.
Meyers, Office Action, U.S. Appl. No. 11/592,008, Sep. 21, 2009, 24 pgs.
Morana, Notice of Allowance and Fees Due, U.S. Appl. No. 11/618,379, May 13, 2009, 4 pgs.
Morana, Office Action, U.S. Appl. No. 11/618,379, Jan. 6, 2009, 7 pgs.
Morana, Office Action, U.S. Appl. No. 12/585,056, Oct. 13, 2011, 8 pgs.
Morana, Office Action, U.S. Appl. No. 29/270,057, Feb. 26, 2009, 5 pgs.
Ormesher, Current Radar Responsive Tag Development Activities at Sandia National Laboratories, Proc. of SPIE vol. 5410, 2004, 7 pgs.
Skiscim, Notice of Allowance and Fees Due, U.S. Appl. No. 12/101,391, Jul. 22, 2011, 18 pgs.
Skiscim, Office Action, U.S. Appl. No. 12/101,391, Jan. 4, 2011, 14 pgs.
Smith, Office Action, U.S. Appl. No. 12/396,447, Dec. 5, 2011, 31 pgs.
Stafford, Notice of Allowance and Fees Due, U.S. Appl. No. 11/681,759, Aug. 13, 2008, 7 pgs.
Stafford, Notice of Allowance and Fees Due, U.S. Appl. No. 11/937,826, Jul. 29, 2011, 8 pgs.
Stafford, Final Office Action, U.S. Appl. No. 11/681,759, May 20, 2008, 8 pgs.
Stafford, Office Action, U.S. Appl. No. 11/681,759, Dec. 21, 2007, 7 pgs.
Stafford, Office Action, U.S. Appl. No. 11/937,826, Sep. 16, 2010, 5 pgs.
Summers, Plug and play testbed to enable responsive space missions, IEEE paper #1221, Mar. 5-12, 2005, 8 pgs.
Zenick Jr., Notice of Allowance and Issue Fee Due, U.S. Appl. No. 09/045,970, Sep. 24, 2001, 2 pgs.
Zenick Jr., Office Action, U.S. Appl. No. 09/045,970, Apr. 10, 2001, 4 pgs.
Zenick Jr., Office Action, U.S. Appl. No. 09/045,970, Oct. 25, 2001, 3 pgs.
Fleeter, Office Action, U.S. Appl. No. 13/422,173, Jun. 8, 2012, 16 pgs.
Fleeter, Office Action, U.S. Appl. No. 13/422,195, Jul. 16, 2012, 23 pgs.
Morana, Office Action, U.S. Appl. No. 12/585,056, Apr. 19, 2012, 5 pgs.
Candell, Notice of Allowance, U.S. Appl. No. 12/692,789, May 10, 2013, 6 pgs.
Fleeter, Notice of Allowance, U.S. Appl. No. 13/422,195, Apr. 23, 2013, 9 pgs.
Fleeter, Office Action, U.S. Appl. No. 13/422,173, May 20, 2013, 21 pgs.
Fleeter, Office Action, U.S. Appl. No. 13/422,195, Dec. 6, 2012, 17 pgs.
McDermott, Final Office Action, U.S. Appl. No. 12/890,578, May 16, 2013, 19 pgs.
Morana, Office Action, U.S. Appl. No. 12/585,056, Apr. 24, 2013, 3 pgs.

(56) References Cited

OTHER PUBLICATIONS

McDermott, Office Action, U.S. Appl. No. 12/890,578, Oct. 26, 2012, 14 pgs.
Morana, Notice of Allowance, U.S. Appl. No. 12/585,056, Nov. 20, 2012, 5 pgs.
Jordan, Final Office Action, U.S. Appl. No. 13/608,146, Jul. 18, 2014, 16 pgs.
Jordan, Office Action, U.S. Appl. No. 13/608,146, Feb. 4, 2014, 8 pgs.
Candell, Notice of Allowance, U.S. Appl. No. 14/041,491, Nov. 7, 2014, 7 pgs.
Fleeter, Notice of Allowance, U.S. Appl. No. 13/422,173, Sep. 26, 2013, 12 pgs.
Jordan, Office Action, U.S. Appl. No. 13/608,146, Jul. 17, 2013, 13 pgs.
McDermott, Notice of Allowance, U.S. Appl. No. 11/739,377, Jul. 19, 2013, 9 pgs.
McDermott, Notice of Allowance, U.S. Appl. No. 12/890,578, Oct. 28, 2013, 19 pgs.
Morana, Notice of Allowance, U.S. Appl. No. 12/585,056, Jul. 22, 2013, 6 pgs.
Candell, Office Action, U.S. Appl. No. 12/692,789, filed Sep. 21, 2012, 10 pgs.
Fleeter, Office Action, U.S. Appl. No. 10/992,173, filed Oct. 17, 2012, 17 pgs.
Smith, Notice of Allowance, U.S. Appl. No. 12/396,447, filed Jun. 5, 2012, 7 pgs.

* cited by examiner

SIGNAL PROCESSING OF A HIGH CAPACITY WAVEFORM

This application claims the benefit and priority of U.S. Provisional Patent Application Ser. No. 61/202,061, filed on Jan. 26, 2009 and entitled "Advanced Software Definable Radio," which is incorporated herein by reference. This application also claims the benefit and priority of U.S. Provisional Patent Application Ser. No. 61/183,391, filed on Jun. 2, 2009 and entitled "Signal Processing of a High Capacity Waveform," which is incorporated herein by reference.

I. FIELD OF THE INVENTION

The present invention relates to methods and systems for signal processing and, more specifically, to methods and systems for detecting, recognizing and processing of waveforms including a High Capacity Waveform (HCW). The present invention also relates to an Advanced Software Definable Radio (ASDR).

II. SUMMARY OF THE INVENTION

An object of the present invention is to provide methods and systems for advanced signal processing of a High Capacity Waveform (HCW). One object of the present invention is to provide a system for generating a HCW to, among other things, increase the forward link data rate (e.g., the data rate of a single-point such as a base station, to a multi-point topology, such as mobile users of a communications device, through an intermediary relay point, such as a geosynchronous satellite). An advantage of increasing the forward link data rate includes the ability to transfer more information than supported by present, legacy systems. Another advantage that is realized by practicing the invention includes, for example, the operation of a receiver device at lower power levels, which may in part be due to one or more modulation techniques of the digital signal(s) representing a frame structure. Yet another advantage is the ability to have significantly improved continuous channel acquisition, which contributes to greater reliability during data recovery. Various features and advantages of the invention will be set forth in the description that follows and, in part, will be apparent to those skilled in the art from the description. The objectives and other advantages of the invention will be realized and attained by the methods and structures particularly pointed out in the written description, the claims, and the drawings.

To achieve these and other advantages, and in accordance with a purpose of the present invention, as embodied and broadly described, the signal processor of a HCW includes a method for generating the HCW, the method comprising the steps of:

receiving an encrypted source data packet and modulating a received encrypted source data signal representing the packet, wherein the modulating step further comprises the steps of:

encoding with high level data link control, scrambling the modulated signal, wherein the scrambling comprises applying digital logic, and encoding the scrambled signal, wherein the encoding comprises using a variable rate low density parity check (LDPC) code for forward error correction (FEC).

In another aspect, the signal processor of a HCW includes a method for generating the HCW, further comprising the step of modulating the encoded scrambled signal, wherein the modulating comprises using quadrature phase-shift keying (QPSK) or binary phase-shift keying (BPSK) for payload data.

In yet another aspect, the signal processor of a HCW includes a method for generating the HCW, further comprising the step of modulating fixed pilot and start of message (SOM) sequences using differential binary phase-shift keying (DBPSK).

In yet another aspect, the signal processor of a HCW includes a method for generating the HCW, further comprising the step of multiplexing the SOM, the fixed pilot, and the payload data according to a frame structure.

In yet another aspect, the signal processor of a HCW includes a method for generating the HCW, further comprising the step of shaping the signal (e.g., spectrally), wherein the shaping comprises using a root raised cosine (RRC) filter (e.g., with an excess bandwidth factor of 0.25).

In yet another aspect, the signal processor of a HCW includes a method for generating the HCW, further comprising the step of digitally upconverting the shaped signal.

In yet another aspect, the signal processor of a HCW includes a method for generating the HCW, further comprising the step of converting the upconverted signal to an analog signal.

In yet another aspect, the signal processor of a HCW includes a method for generating the HCW, further comprising the step of upconverting the analog signal to an intermediate frequency (IF) signal.

In yet another aspect, the signal processor of a HCW includes a method for generating the HCW, further comprising the step of upconverting the IF signal to a C-band signal for satellite transmission.

In yet another aspect, the signal processor of a HCW includes a method for generating the HCW, further comprising the step of translating the C-band signal to an L-band signal.

In yet another aspect, the signal processor of a HCW includes a method for generating the HCW, further comprising the step of applying channelization filtering to the L-band signal.

In yet another aspect, a computer-readable storage medium having stored thereon computer-executable instructions that, when executed on a computer, cause the computer to perform a method for generating the HCW, the method comprising the steps of:

receiving an encrypted source data packet and modulating a received encrypted source data signal representing the packet, wherein the modulating step further comprises the steps of:

encoding with high level data link control, scrambling the modulated signal, wherein the scrambling comprises applying digital logic, and encoding the scrambled signal, wherein the encoding comprises using a low density parity check (LDPC) code for forward error correction (FEC).

In yet another aspect, a system comprising one or more processors, memory, one or more programs stored in memory, the one or more programs comprising instructions to:

receive an encrypted source data packet;

modulate a received encrypted source data signal representing the packet, wherein the modulating step further comprises the steps of:

encoding with high level data link control;

scrambling the modulated signal, wherein the scrambling comprises applying digital logic; and encoding the scrambled signal, wherein the encoding comprises using a variable rate low density parity check code for forward error correction.

Further to achieving these and other advantages, and in accordance with a purpose of the present invention, as embodied and broadly described, the advanced software definable radio includes: a modular enclosure; a baseband board attached to the modular enclosure; the baseband board having (a) a processor complex, (b) an FPGA complex, and (c) a cryptographic engine; an RF module connected to the baseband board; and an antenna interface connected to the RF module and the modular enclosure, the antenna interface configured to accept a removable antenna.

In yet another aspect, the advanced software definable radio, wherein the cryptographic engine comprises a self-contained, tamperproof enclosure having at least one microprocessor that can be programmed without accessing the self-contained module.

In yet another aspect, the advanced software definable radio, wherein the at least one microprocessor is reprogrammable.

In yet another aspect, the advanced software definable radio, further comprising a GPS module operatively connected to the antenna interface and the RF module.

In yet another aspect, the advanced software definable radio, wherein the antenna interface is configured to accept any one of an L-Band, L-Band with line of sight mesh, Ku-Band, X-Band, and S-Band antennas.

To achieve these and other advantages, and in accordance with the purpose of the present invention, as embodied and broadly described, the signal processor of a HCW includes a method for tracking a HCW, the method comprising the steps of: receiving a waveform signal; comparing the received waveform signal to at least one stored signal parameter; generating a quality score, the magnitude of the quality score inversely proportional to the difference between the received waveform and the at least one stored signal parameter; and generating a control signal that directs a signal receiver to track the received waveform if the magnitude of the quality score exceeds a minimum threshold.

In yet another aspect, the signal processor of a HCW includes a method for tracking the HCW, further comprising the step of identifying the received waveform signal as a high capacity waveform if the quality signal exceeds the minimum threshold.

Further to achieving these and other advantages, and in accordance with the purpose of the present invention, as embodied and broadly described, a system is described for tracking a HCW, the system comprising an interface for receiving a waveform signal and a processor connected to the interface, the processor including: a first comparison module for comparing a received waveform signal to at least one stored signal parameter, a quality score module for generating a quality score, the magnitude of the quality score inversely proportional to the difference between the received waveform and the at least one stored parameter, and a control module for generating a control signal, wherein the control module generates a control signal that directs a signal receiver to track the received waveform if the quality score exceeds the minimum threshold.

In yet another aspect, a computer-readable storage medium having stored thereon computer-executable instructions that, when executed on a computer, cause the computer to perform a method of tracking a HCW, the method comprising the steps of: receiving a waveform signal; comparing the received waveform signal to at least one stored signal parameter; generating a quality score, the magnitude of the quality score inversely proportional to the difference between the received waveform and the at least one stored signal parameter; and generating a control signal that directs a signal receiver to track the received waveform if the quality score exceeds a minimum threshold.

It should be understood that the foregoing general description and the following detailed description are exemplary and explanatory, and are intended to provide further explanation of the invention as claimed.

III. BRIEF DESCRIPTION OF THE DRAWINGS

The accompanying drawings, which are included to provide a further understanding of the invention, and are incorporated in and constitute a part of this specification, illustrate exemplary embodiments of the invention and together with the description serve to explain the principles of the invention.

IV. DETAILED DESCRIPTION OF THE EXEMPLARY EMBODIMENTS

Figure 1A:
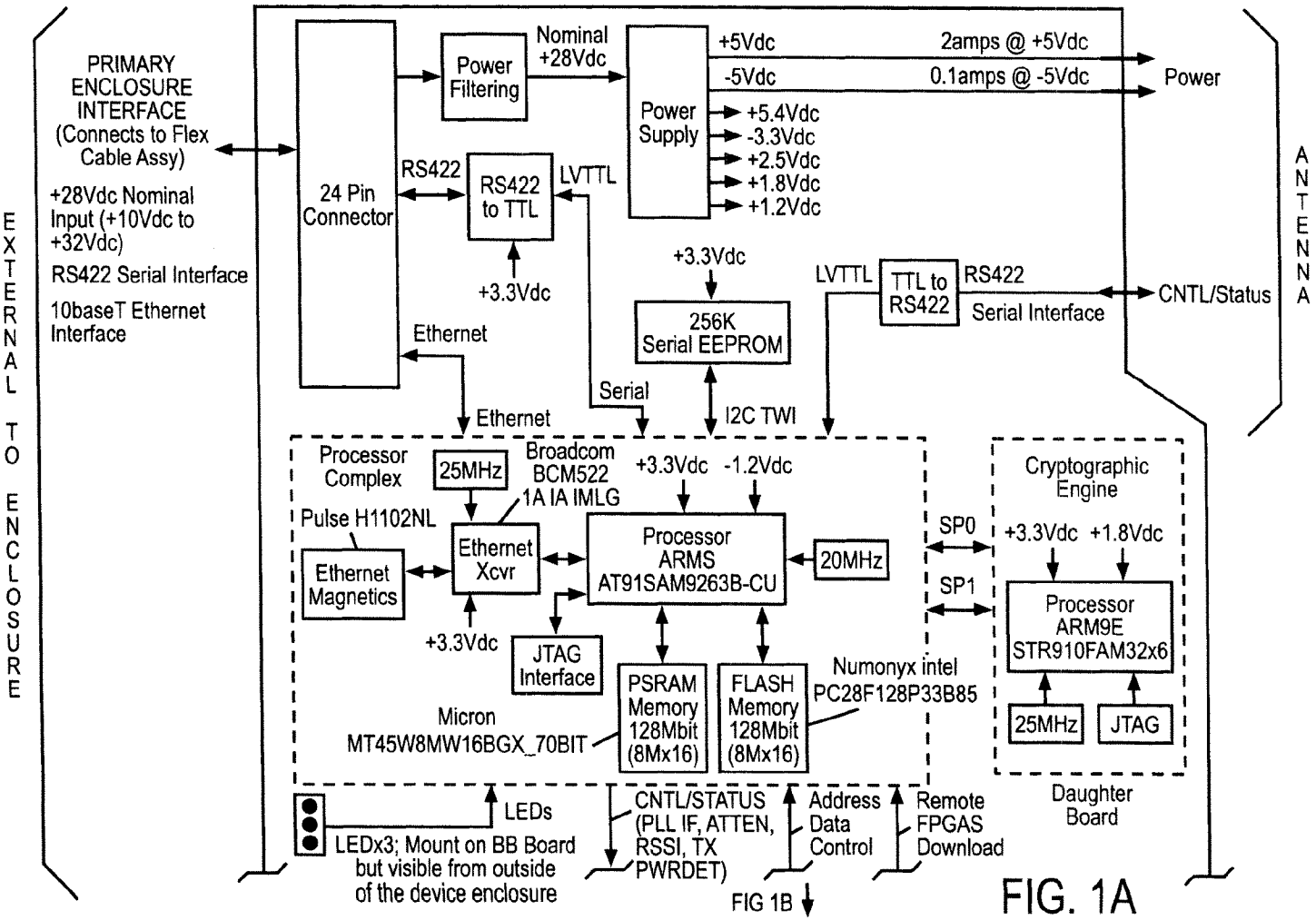
FIGS. 1A and 1B illustrate an exemplary block diagram of an ASDR baseband board.

Reference will now be made in detail to the embodiments of the present invention, examples of which are illustrated in the accompanying drawings.

A. Overview

The Advanced Software Definable Radio (ASDR) described herein is a half or full duplex advanced transceiver capable of hosting a High Capacity Waveform (HCW), a broadband global area network (BGAN), a wide area network (WAN), and satellite waveforms. Software within the ASDR generates the HCW waveforms through signal processing, allowing a common hardware platform to transmit and receive multiple waveforms. In certain exemplary embodiments, the ASDR transceiver fits the MT-2011 transceiver (described below) form factor for width and depth, and is under the stipulated MT-2011 height. The MT-2011 transceiver is a commercially available component of Comtech Mobile Datacom's near real-time packet data network, which provides satellite-enhanced communications services to a broad range of markets including, but not limited to, the trucking, aviation and maritime markets. The ASDR of the present invention incorporates a HCW and, in certain embodiments, interfaces with an advanced high-performance tracking antenna with over approximately 8 dBic gain. In certain embodiments, the ASDR incorporates the MTM-203 (described below) functionalities in its electronics platform. The MTM-203 is a commercially available L-Band satellite transceiver module made by Comtech Mobile Datacom that provides secure, near real-time, mobile communications to commercial and other users. Additional information on the MTM-203 is contained in U.S. patent application Ser. No. 11/685,936 filed on Mar. 14, 2007, which is incorporated herein by reference.

The ASDR used in the present invention is described in U.S. Patent Application Ser. No. 61/202,061, which is incorporated herein by reference. In certain embodiments, for example, the ASDR is an aviation-compliant transceiver in accordance with Aeronautical Design Standard 37 A (ADS-37A), which is incorporated herein by reference. The ASDR operates in full or half duplex, and at multiple data rates. The ASDR is software reprogrammable and provides full I-Fix filtering. I-Fix filtering enables a transceiver to operate in the presence of very high power RF emissions present in, for example, many vehicles. In other exemplary embodiments, I-Fix filtering on the receiver allows the device to operate in the presence of outer-band high power interference. In one embodiment, the ASDR may be used with the HCW as described herein, but also fully supports legacy waveform operations (described below), allowing it to interoperate with both HCW and non-HCW transceivers on existing satellite channels.

The ASDR transceiver supports multiple selectable forward link data rates, including data rates for the high capacity waveform (HCW) mode. Data rates include (a) 230 kbps with a 2 to 8 dB margin at above a 20 degree elevation angle, (b) 129 kbps with a 7 to 13 dB margin above a 20 degree elevation angle, with a worst case (WC) 2 dB margin at a 5 degree elevation angle (effectively at the horizon), and (c) 51 kbps with an 11 to 17 dB margin at above a 20 degree elevation angle, and a WC 6 dB margin at 5 degrees. The 51 kbps is ideal for operational areas with poor channel characteristics such as low elevation angles and heavily forested or jungle areas.

The ASDR can also operate with legacy waveforms, supporting multiple data rates including, but not limited to ¼×, 1×, 2×, 4× and 8× with the standard 1× data rate being 2.6 kbps. This legacy waveform and its spread spectrum transmission characteristics provide the transceiver another low probability of intercept (LPI), low probability of detection (LPD) attributes. The ASDR transceiver can also share one or more forward and return link satellite channels with an MT-2011 transceiver using, for example, a time domain multiplexing processing approach, or other satellite transmission techniques known to those skilled in the art.

B. Functional Description

In the exemplary embodiment shown, the ASDR has a Baseband Board, an RF Board, and an Antenna, each of which are described in more detail below.

1. Baseband Board

Figure 1B:
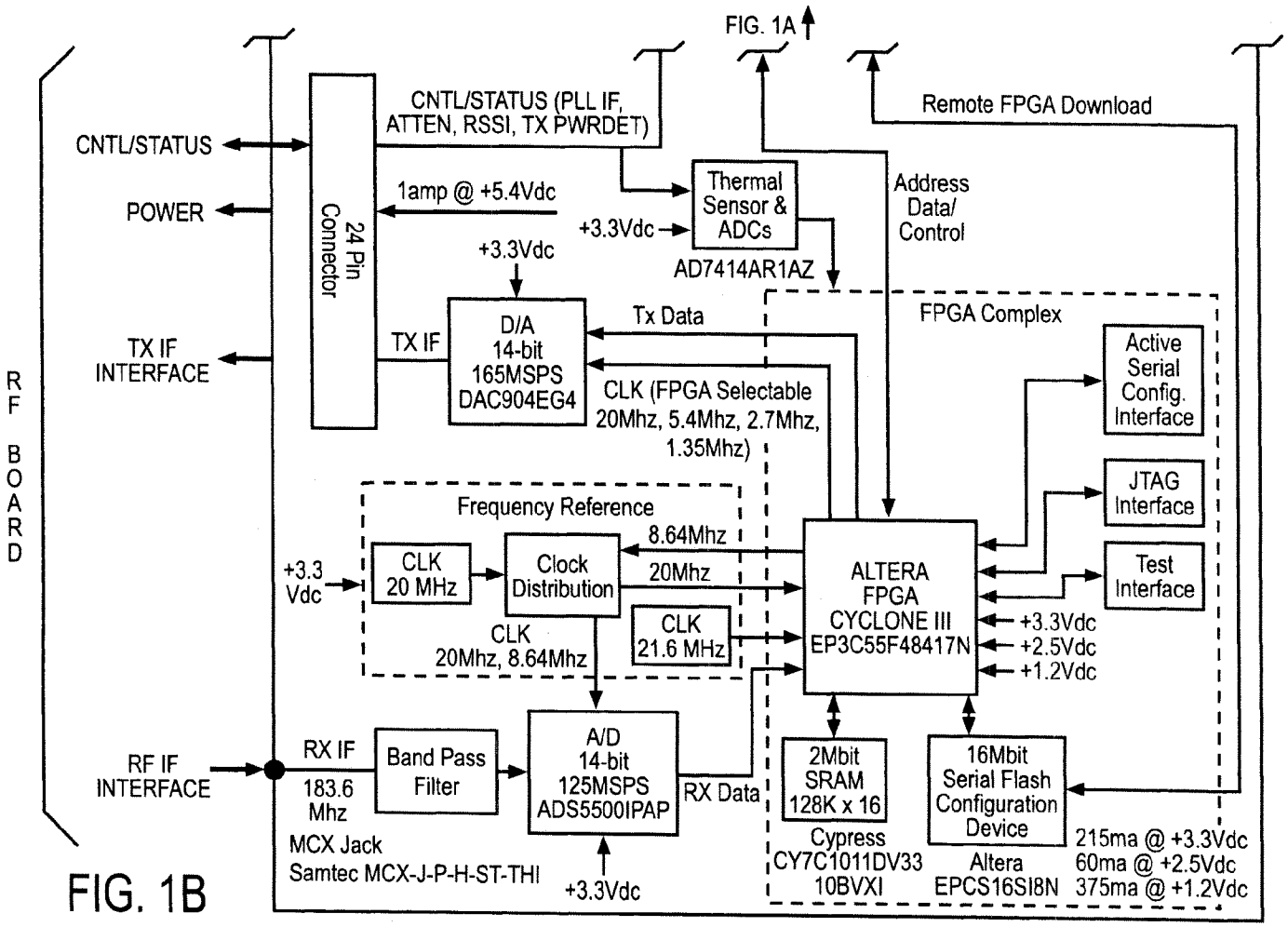

FIGS. 1A and 1B illustrate an exemplary block diagram of an ASDR baseband board. In the embodiment shown, primary power input and I/O signal interfaces are implemented using a Comtech MT-2011 MIL-38999 connector/flex cable assembly with a power input of +28 Vdc nominal with an operating range of +20 Vdc to +33 Vdc. In the embodiment shown, the power is then filtered and converted to other voltages as needed. The baseband board shown also includes, but is not limited to, a field-programmable gate array (FPGA) complex, a processor complex, and a cryptographic engine, which are described in more detail below.

a. Processor Complex

Figure 2A:
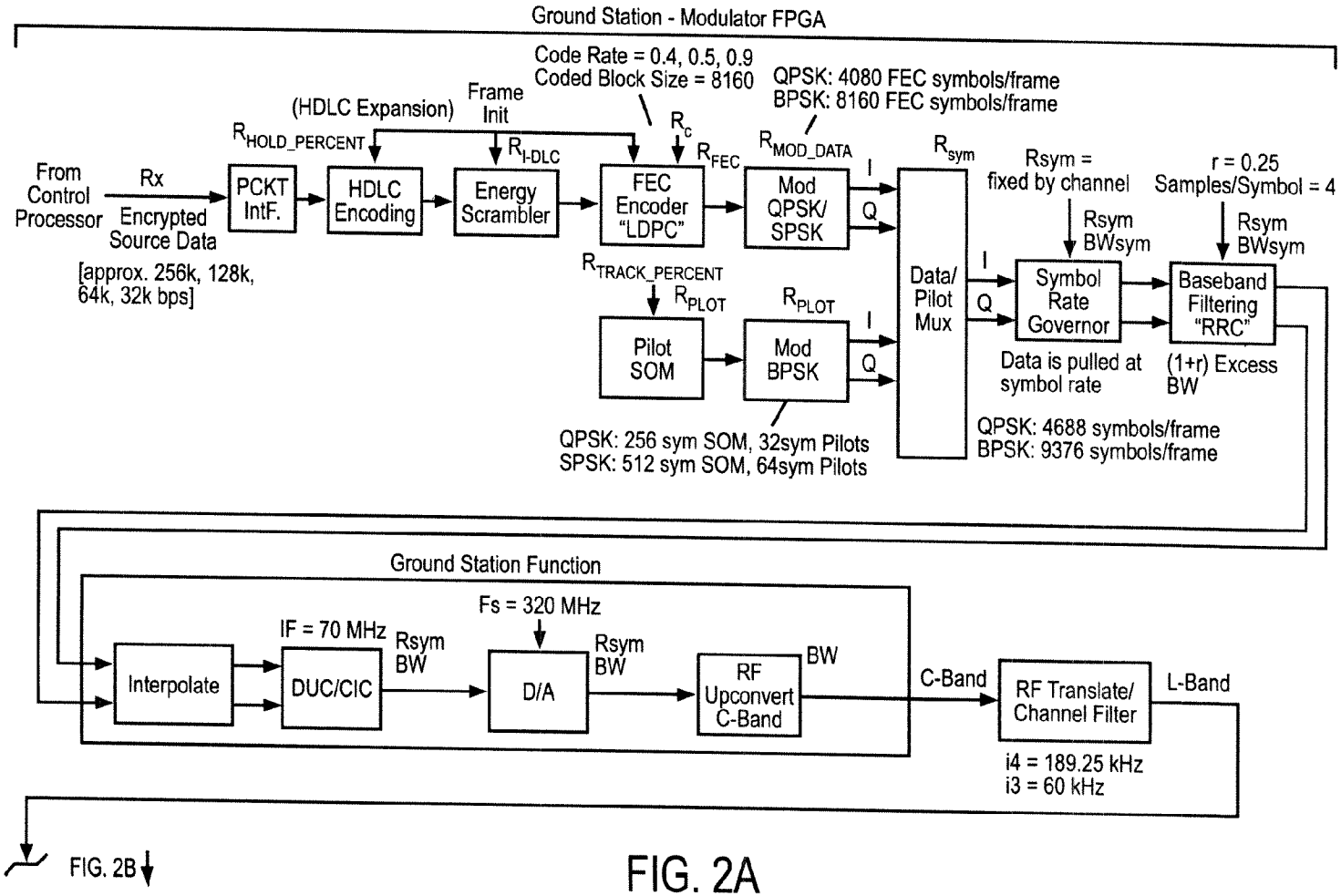
FIGS. 2A and 2B illustrate an exemplary embodiment of an interface between a FPGA complex and a processor complex.
Figure 2B:
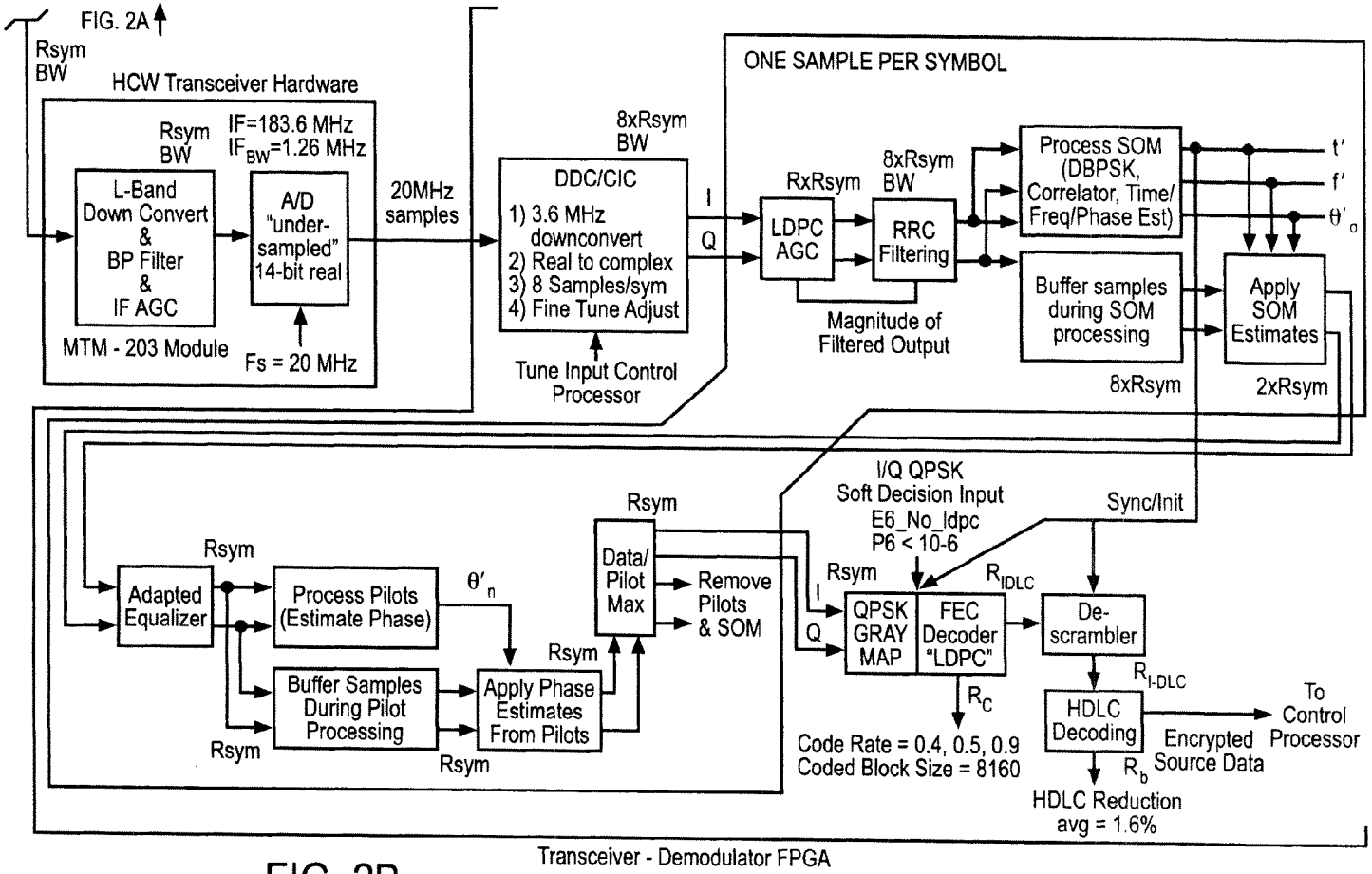

In the exemplary embodiment shown in FIG. 1A, the processor complex (also referred to as the control processor) holds the firmware and software controlling the transceiver operation, with the exception of the encryption (contained in the cryptographic engine in the embodiment shown) and the high capacity waveform (controlled by the FPGA complex in the embodiment shown). Although not shown in FIGS. 1A and 1B, other embodiments include a GPS unit that interfaces with the processor complex. In the embodiment shown, the processor complex connects to the FPGA complex via an address/data/control line. FIGS. 2A and 2B illustrate an exemplary embodiment of an interface between an FPGA complex and a processor complex.

The processor complex of FIG. 1A operates at speeds up to approximately 200 MHz or higher and has a minimum of approximately 512 kB DRAM and a minimum of approximately 1 MB of flash memory. These frequencies and memory capacities are exemplary only, and can vary above or below these numbers without departing from the scope of the invention. In the embodiment shown, a thermal sensor is incorporated on the baseboard and is accessible via the processor complex. It has a Joint Test Action Group (JTAG) interface, one or more serial interfaces, an antenna control/status interface, and an RF board control/status interface. The processor complex has an Ethernet transceiver and an Ethernet interface that may, but need not be, IEEE 802.3 compliant. In certain embodiments, the Ethernet electrical connection (physical layer connection) is implemented using one or more of a combination of PCB traces, flex cable, and twisted wire pairs. Other connection methods known to those skilled in the art can also be used without departing from the scope of the invention. The processor complex shown in FIG. 1A is exemplary only, and not limited to what is shown. This embodiment includes an Atmel ARM9™, however other processors can be used that are capable of operating within the scope of the invention.

b. FPGA Complex

FIG. 1B illustrates an exemplary embodiment of an FPGA complex for use in generating a HCW waveform. In the embodiment shown, the FPGA complex interfaces with the processor complex and processes the high capacity and legacy waveforms. FIGS. 2A and 2B show an exemplary embodiment of the interface between the FPGA complex and the processor complex. In the embodiment shown in FIGS. 1A-B and 2A-B, the FPGA also interfaces with a transmit interface digital-to-analog (D/A) converter and a receive interface analog-to-digital (A/D) converter, and interfaces with a frequency reference having one or more clock signals. The frequency reference driving the A/D converter and the FPGA is approximately 20 MHz, with a stability of less than approximately 2 ppm and a jitter of less than or equal to approximately 2 ps. The A/D and D/A converters have a signal-to-noise ratio (SNR) above approximately 50 dB and a spurious-free dynamic range (SFDR) above approximately 60 dB. The converters have 14 bits and employ a sampling rate of approximately 20 MHz with an intermediate frequency, Fin (the IF input) of approximately 183.6 MHz. The analog bandwidth is twice the Fin, or approximately 367.2

MHz. The converter sample rate is approximately 20 MHz, with the clock source less than approximately 2 ppm and a jitter level below approximately 2 ps, with total jitter levels below approximately 2.5 ps. In other embodiments, the D/A converter can support clock rates of 5.4 MHz, 2.7 MHz, and 1.35 MHz.

In certain embodiments, the FPGA operates by default in an active serial standard mode. Once the active FPGA image is stored in a flash memory, it can be loaded from the flash memory without external assistance after power-up. The FPGA may also have additional images stored in the processor flash, with at least one of them being a duplicate of the active image. The FPGA processor can load one of the images in flash memory into the FPGA microprocessor to make it the active image. The FPGA is programmable and/or reprogrammable via one or more of a JTAG port, an active serial configuration interface port, and a host processor download connection (shown in this exemplary embodiment as a remote FPGA interface between the FPGA complex and the processor complex, with a serial configuration flash device accepting the remote FPGA download). These FPGA interfaces may also be used for testing, and can be used to load the code for modulating and/or demodulating the HCW.

In certain embodiments, the FPGA code is a hardware descriptive language such as, for example, the very-high-speed-integrated circuit (VHSIC) hardware descriptive language (referred to as VHDL). The FPGA complex may also have an SRAM, which in the exemplary embodiment shown is a 2 Mb SRAM. The type and size of the flash device and SRAM are exemplary only, and not limited to what is shown. Although the FPGA shown is an Altera Cyclone III™, other FPGAs may be used without departing from the scope of the invention. Other components and/or other values known to those skilled in the art may also be used without departing from the scope of the invention.

(i.) High Capacity Waveform (HCW)

Figure 3A:
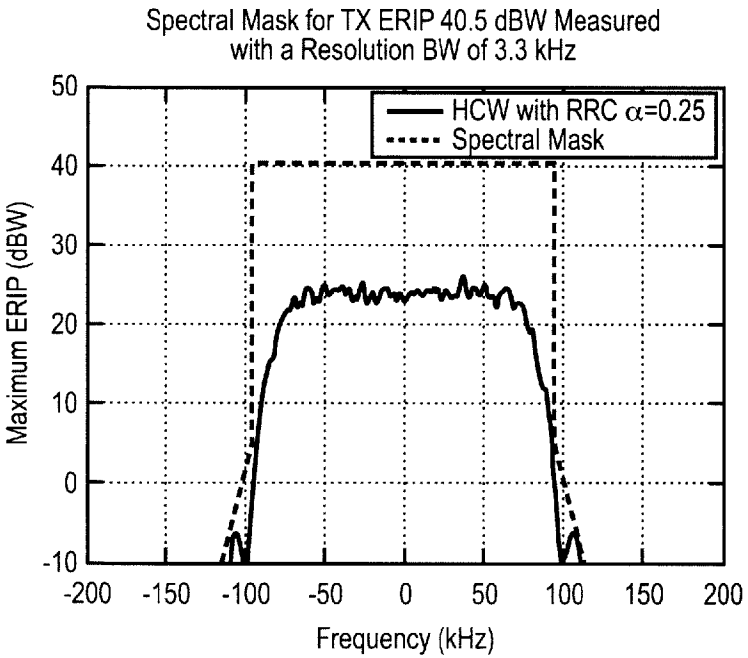
FIGS. 3A and 3B illustrate selected properties of an exemplary embodiment of a high capacity waveform.
Figure 3B:
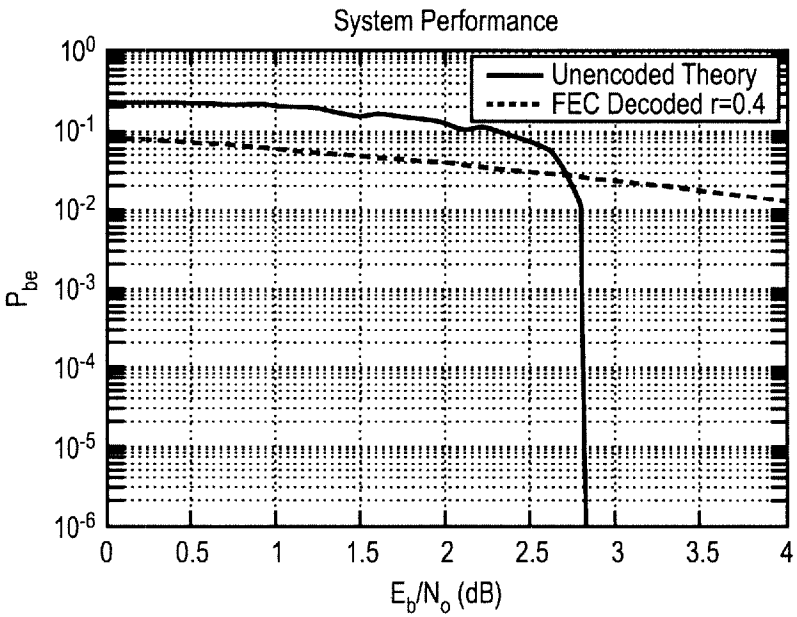

FIGS. 3A and 3B illustrate selected properties of an exemplary embodiment of a HCW. FIGS. 3A and 3B assume a root-raised cosine (RRC) filter with variable alpha (nominal alpha of 0.25), and a system performance in a Rician K-10 channel with a maximum Doppler shift of 111 Hz. The figures also assume a frequency offset of −4 kHz, a phase offset of $\pi/2$ radians, and a timing offset of 1/16 of a symbol. As shown in FIG. 3A, maximum equivalent isotropcially radiated power (EIRP) quickly drops-off outside the spectral mask for a transmit EIRP of 40.5 dbW measured with a resolution bandwidth of 3.3 kHz. FIG. 3B compares system performance of the theoretical unencoded system performance with the forward error correction (FEC) decoded performance, assuming r=0.4.

The HCW provides reliable point-to-multipoint satellite communications in a hostile tactical environment. The HCW also has exceptional anti-jamming performance through, for example, a robust acquisition scheme, and enables signal scrambling, interleaving, and forward error correction (FEC). In certain embodiments, the ASDR uses a fully synchronous design utilizing a single clock.

The flexibility provided by the HCW enables the user to customize the core to fit the resources of the target platform. HCW operational parameters may be also configured to optimize performance in harsh channel conditions and for efficient implementation optimized for low power operation in a reduced satellite footprint. In certain exemplary embodiments, the HCW modem core is well-suited for small form factor software defined radios, and in other exemplary embodiments, the ASDR modem core requires only a single processor.

The FPGA complex processes the HCW software (and/or, firmware), and interfaces with the processor complex via at least one address/data/control line. In the embodiment shown, the FPGA architecture and processor complex enable the HCW to extend communication range and increase reliability and spectral efficiency in point-to-multipoint satellite communications. Examples of high capacity waveforms include, but are not limited to, coherent quadrature phase shift keying (QPSK) and binary phase shift keying (BPSK). In certain embodiments, the high capacity waveform complies with Inmarsat emission requirements. The HCW may also be used, for example, for forward link applications (with or without legacy support), for increased data capacity without sacrificing detection efficiency, and for enhanced link margin with advanced demodulation and forward error correction (FEC). In certain embodiments, the FEC employs an advanced low density parity code (LDPC) with multiple code selections developed by Comtech Telecommunications. Exemplary advanced low density parity codes are described in U.S. Pat. Nos. 7,353,444 and 7,415,659, which are incorporated herein by reference.

One embodiment employing the HCW has a modem implementation loss of less than approximately 0.5 dB, a carrier acquisition and tracking range of approximately +/−4 kHz, and supports sustained user throughput data rates from approximately 2 kbps to over 230 kbps. Assuming, for example, the transceiver has a G/T above approximately −24 dB/K and is operating in the Inmarsat 4 (40.5 dBW) system, the HCW may have a carrier-to-noise ratio (C/N) above approximately 59 dB-HZ, which supports a 232 kbps data rate operation. At this exemplary data rate, the HCW employed a nominal symbol rate of approximately 150.6 thousand symbols per second (ksym/s). In other embodiments, the symbol rate varied from approximately 60 ksym/s to approximately 200 ksym/s, with fractional Hz resolution. These exemplary waveforms may operate as half or full duplex based on user terminal capability. In certain embodiments, the ASDR modulator and demodulator are available in VHSIC Hardware Descriptive Language (VHDL) modules. The VHDL modules handle the signal processing tasks of HCW modulation and/or demodulation operations. VHDL software enables implementation of the core in any commercially available field programmable gate array (FPGA) or application specific integrated circuit (ASIC).

(ii.) Quality Signal

In certain exemplary embodiments, the FPGA complex produces a quality signal, which may be used to produce a control signal for controlling the ASDR antenna's detection, acquisition, and tracking of a HCW signal. When the antenna receives a signal, the FPGA complex analyzes the received waveform to determine whether it matches the parameters of a HCW signal. In certain embodiments, the FPGA complex does this by comparing the received waveform to at least one stored parameter that may, but need not, be stored in the FPGA. The FPGA then compares the received signal parameters to the at least one stored parameter and generates a quality score. The magnitude of the quality score is inversely proportional to the difference between the received signal parameters and the at least one stored parameter. If the quality score exceeds a minimum threshold, the FPGA tells the processor complex to generate a control signal that in turn directs the antenna to track the received waveform signal. In certain embodiments, the processor complex further controls the antenna by comparing the quality score as the antenna beam moves off a given axis, and directs the antenna to move toward an axis having a higher quality score.

c. Cryptographic Engine

In the exemplary embodiment shown in FIG. 1, the cryptographic engine is a self-contained, tamper-proof cryptographic engine that supports rewriting without replacement of the chip or reprogramming and recertification by a manufacturer/government agency. In the embodiment shown in FIG. 1, the cryptographic engine interfaces with the processor complex, but is physically separate from the processor and other components. The cryptographic engine is sealed with a tamper line routed on the perimeter using at least one resistor to detect malicious entry and/or attempted entry into the cryptographic engine. Other tamper proof seals, such as a printed circuit board trace, for example, may also be used instead of or in addition to the at least one resistor without departing from the scope of the invention. The cryptographic engine contains its own hardware, firmware, and software separate from the rest of the ASDR, allowing for access to the remainder of the ASDR without compromising the integrity of the cryptography contained within the engine, thus enabling technicians to service the radio in the field. In certain embodiments, the cryptographic engine is soft-programmable, allowing cryptographic material to be loaded into the engine without having to break the tamper seal, therefore enabling the cryptographic material in the engine to be updated or switched entirely without having to recertify the integrity of the cryptographic engine module.

In certain embodiments, the cryptographic engine uses the advanced encryption standard (AES). Other encryption standards also may be used. The engine shown has a JTAG interface for programming and debugging, and at least 50 key slots. The embodiment shown has at least one key, with a time per key (assuming a worst performing algorithm) of approximately 40 microseconds or less. The key traversal distribution is 4 keys maximum for TO identities and 6 keys maximum for FROM identities. The total time from packet input for trial decryption to user delivery is less than approximately 450 microseconds. The cryptographic engine shown has a minimum data rate of approximately 5 Mbps, a minimum of 64 kb of RAM, and a minimum of 64 kb of flash memory. These values are exemplary only and not limited to what is described. For example, while the cryptographic engine shown uses an ST Microelectronics™ microprocessor, it need not be that particular product. Other microprocessors may be used without departing from the scope of the invention. Other values and other cryptographic components known to those skilled in the art may also be used without departing from the scope of the invention.

2. RF Board

Figure 4:
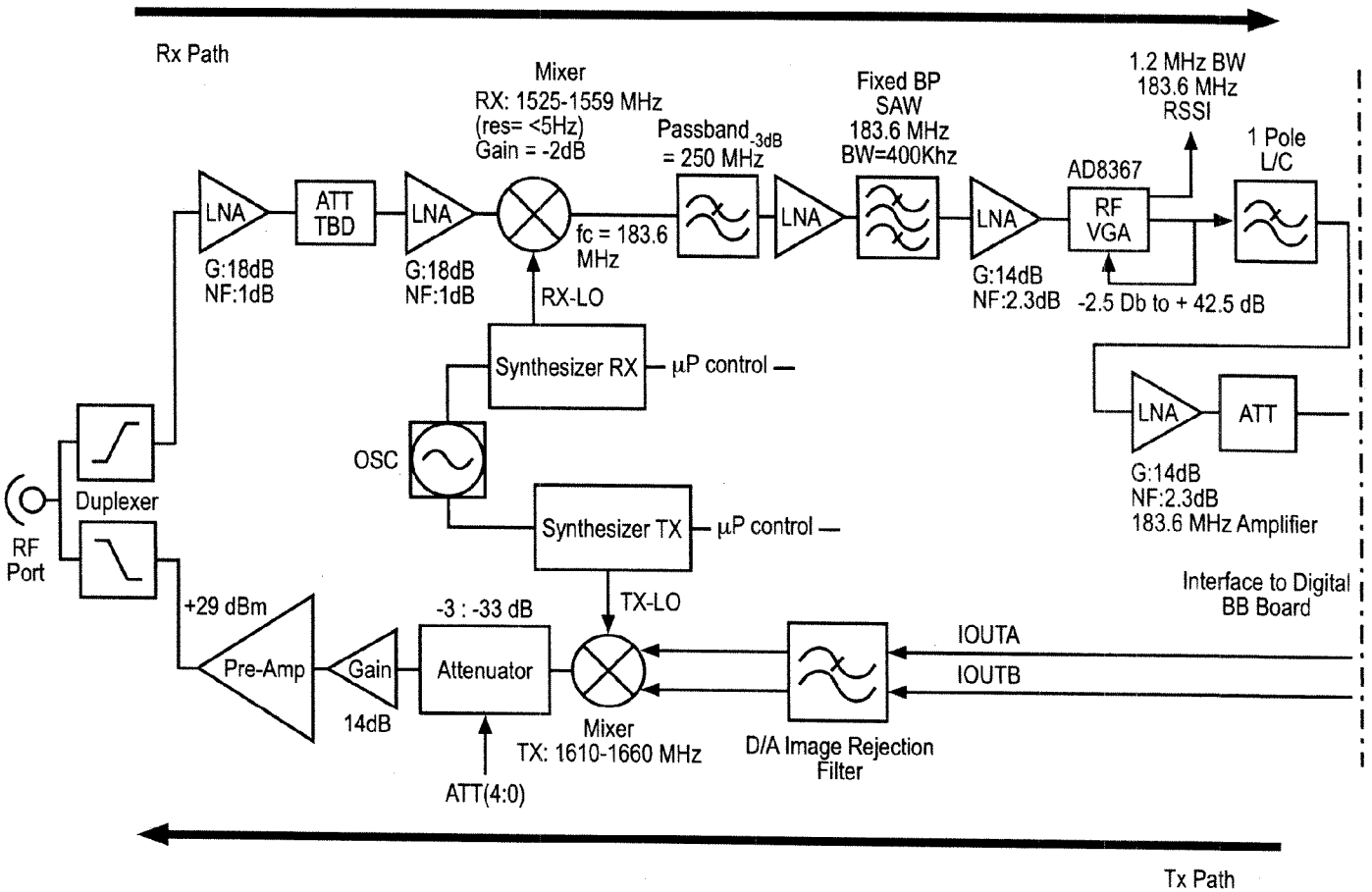
FIG. 4 illustrates an exemplary embodiment of an ASDR RF board.

FIG. 4 illustrates an exemplary embodiment of a full-duplex ASDR RF board. In the embodiment shown, the RF board includes an RF receiver circuit and RF modulator circuit with a 1-Watt power amplifier, a PLL synthesizer, and at least one antenna interface duplexer. The RF port is a full duplex port (i.e., the transmit and receive signals connect to the same port) but need not be. In certain exemplary embodiments, the RF Board is ETSI and FCC compliant, and may also comply with one or more standards including, but not limited to, MIL-STD-1275B, MIL-STD-704F, MIL-STD-464, MIL-STD-461F, MIL-STD-1472F, MIL-HDBK-704-8, and MIL-STD-810F. In certain embodiments, the RF board also includes shielding and/or a SAW filter.

In the embodiment shown in FIG. 4, a received signal is sent to a duplexer, which sends the signal to at least one low noise amplifier (LNA). In the embodiment shown, the LNA has a gain of approximately 18 dB and a noise factor (NF) of approximately 1 dB. After passing through the LNA the signal is inputted into a mixer for conversion to a receive frequency band (1525-1559 MHz, for example), with the converted signal sent to a 250 MHz passband filter. The received signal mixer is controlled by a receive synthesizer, which is, in turn, controlled by a microprocessor control signal from the baseband board processor complex. After passing through the passband filter, the converted receive signal passes through an optional additional LNA and into a 183.6 MHz fixed bandpass SAW filter with a 400 kHz bandwidth, and then into another low noise amplifier. In the exemplary embodiment shown, the LNA has a gain of approximately 14 dB and a noise factor of approximately 2.3 dB. The signal is then input into an RF voltage gain amplifier (VGA). In the exemplary embodiment shown, the VGA outputs to a 183.6 MHz Received Signal Strength Indicator (RSSI) with a 1.2 MHz bandwidth, and to a single-pole LC (inductor/capacitor) circuit. The VGA also feeds back into itself with a variable gain range of −2.5 to +42.5 dB. The single-pole LC circuit sends its output into another LNA, shown here with a gain of approximately 14 dB and a noise factor of approximately 2.3 dB, which then inputs into an attenuator before being sent to an analog-to-digital input on the Baseband Board. The values shown in the components in the transmission path are exemplary only, and not limited to what is shown. Other gains, noise factors, frequencies, bandwidths, etc. may be used without departing from the scope of the invention.

On the transmission side of the RF board shown, at least one signal (referred to generically herein as a signal) is sent from the baseband board to a digital to analog image rejection filter. The filtered signal is then inputted to a mixer for conversion to the transmission frequency band (1610-1660 MHz, for example), with the converted signal sent to a programmable attenuator controlled by the baseband board. The transmission signal mixer is controlled by a transmission synthesizer, which is, in turn, controlled by a microprocessor control signal from the baseband board. After passing through the transmission attenuator, the signal gain is increased by approximately 14 dB and fed into a pre-amplifier, which increases the signal by approximately 29 dBm and inputs into a duplexer, which in turn inputs into an RF port for transmission.

3. Antenna Module

Figure 5:
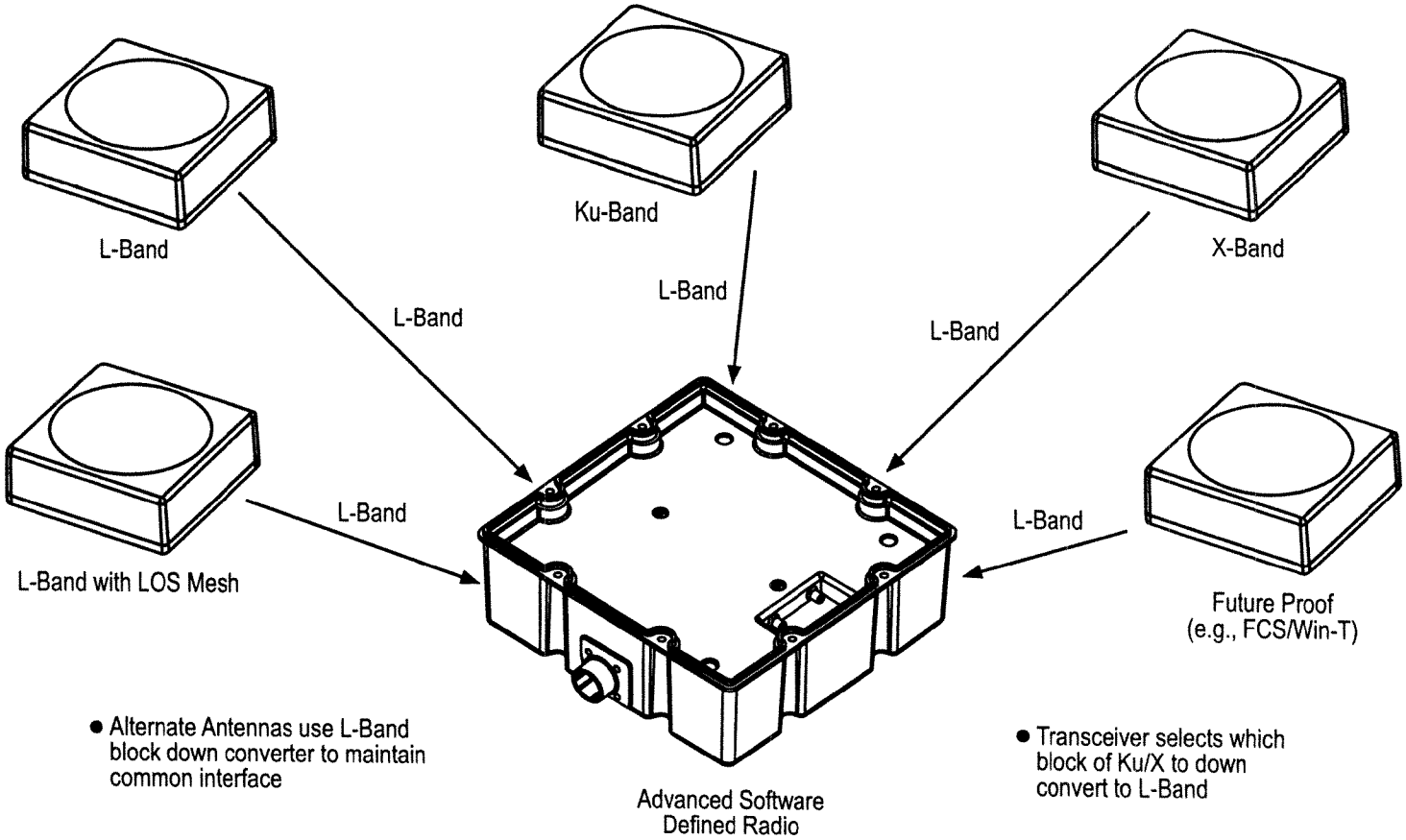
FIG. 5 illustrates an exemplary embodiment of a modular ASDR antenna.

FIG. 5 illustrates an exemplary embodiment of a modular ASDR antenna for use with the HCW. In the embodiment shown, the ASDR antenna supports multiple modules, including but not limited to, (a) an S-Band antenna patch to support use on a low earth orbit (LEO) satellite, (b) an Iridium Sparse Mode capability, (c) an Inmarsat Class-12 mobile module, (d) an Inmarsat Sparse Mode capability module, and (e) an L-Band antenna module with a line of sight (LOS) Mesh configuration. In another embodiment, the ASDR antenna interface includes a Ku band antenna module, and in still further embodiments, the ASDR antenna includes an interface for an X band module. In the exemplary embodiments of FIG. 5, an antenna adapter uses an L-Band block down-converter to maintain a common interface, wherein the transceiver selects which frequency block (Ku, X, S, for example) to down-convert to the L-Band.

In certain exemplary embodiments, an ASDR interface connects with a removable antenna module that fits within the footprint of an MT-2011. In these exemplary embodiments, the ASDR electronics may be placed inside a vehicle or other communications platform in such a way that only the antenna is exposed to outside elements. The antenna module can be removed without also having to remove the ASDR electronics, allowing for field servicing, repair, or replacement of a damaged ASDR antenna. In certain embodiments, the ASDR antenna has at least one electrically steerable quadrifiler helix antenna element. This antenna uses phase shifting with three-degree phase stability. The antenna also has 0.5 dB amplitude stability and approximately a 4 dB insertion loss. In certain embodiments, the antenna has a 7-beam hemisphere sweep (with approximately 50 beams total). It may also include a highly efficient differential interface between phase shifter/antenna elements, and may also have improved cross-polarization discrimination (XPD) with spectrum sharing options. A non-limiting exemplary antenna element is disclosed in U.S. patent application Ser. No. 11/952,461.

In certain embodiments, the ASDR antenna receives a control signal that directs the antenna to detect, acquire, and track a high capacity waveform signal, at up to approximately sixty degrees per second. In certain embodiments, the antenna also has one or more accelerometers, gyros, and/or GPS inputs to help with signal detection, acquisition, and tracking. In certain embodiments the accelerometers, gyros, and/or GPS inputs come from the antenna module itself and, in other embodiments, one or more of these inputs may come from the ASDR electronics.

C. Physical Configuration

Figure 6A:
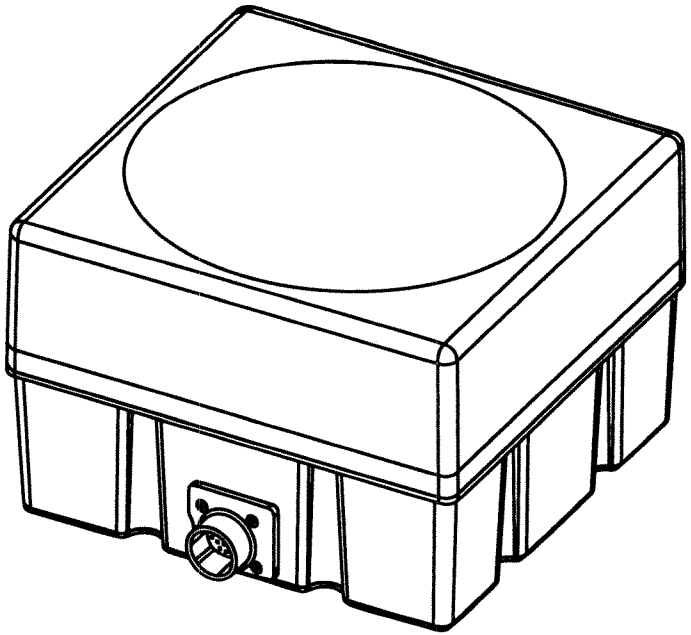
FIGS. 6A-6E illustrate the physical configuration of an exemplary embodiment of the advanced software definable radio.
Figure 6B:
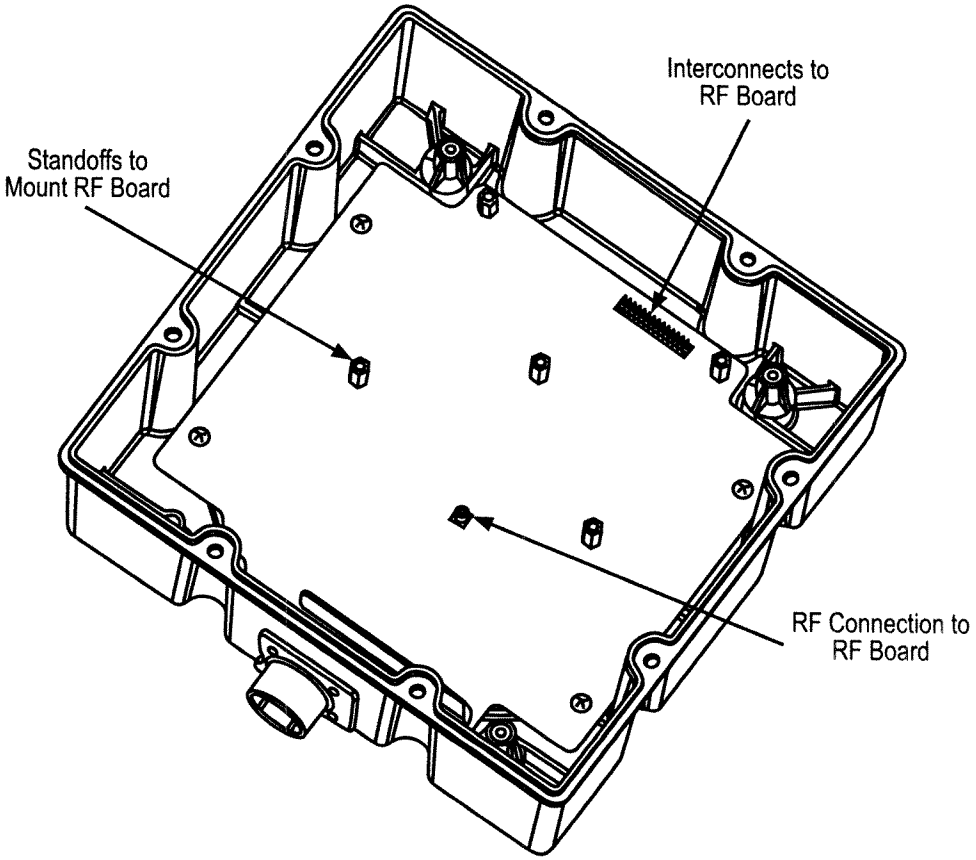
Figure 6C:
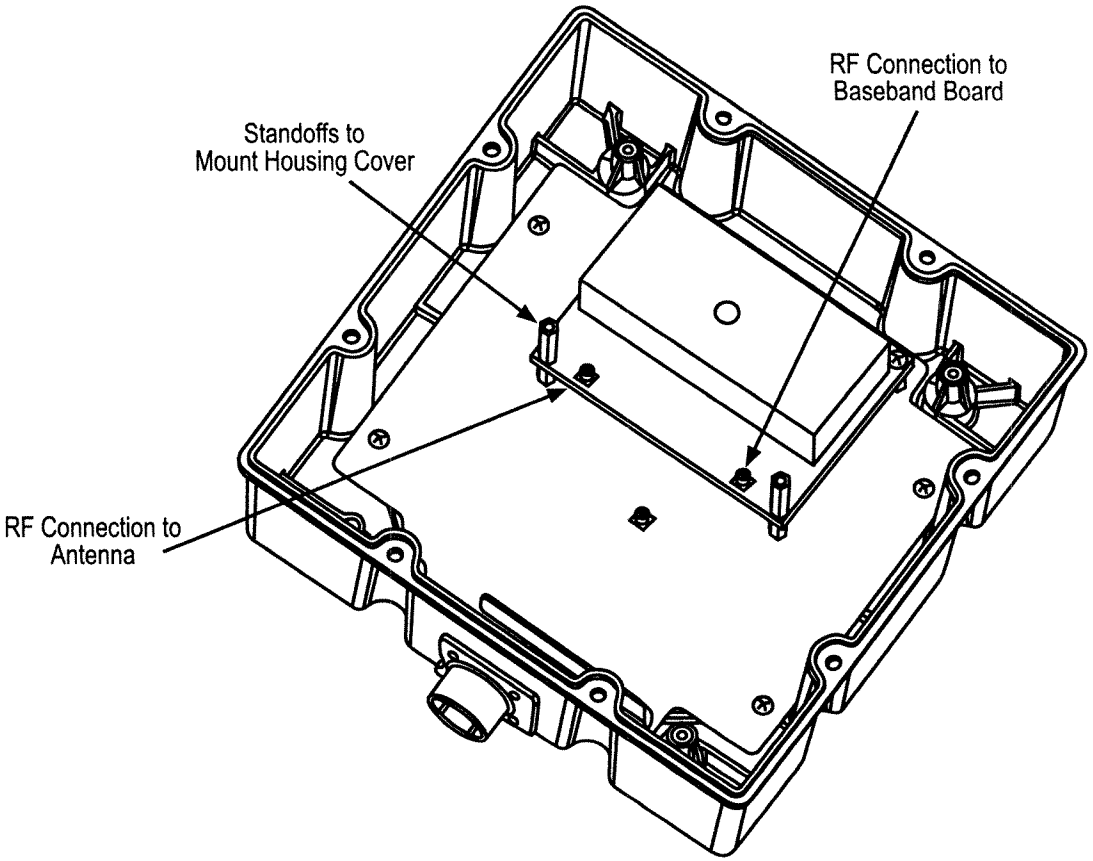
Figure 6D:
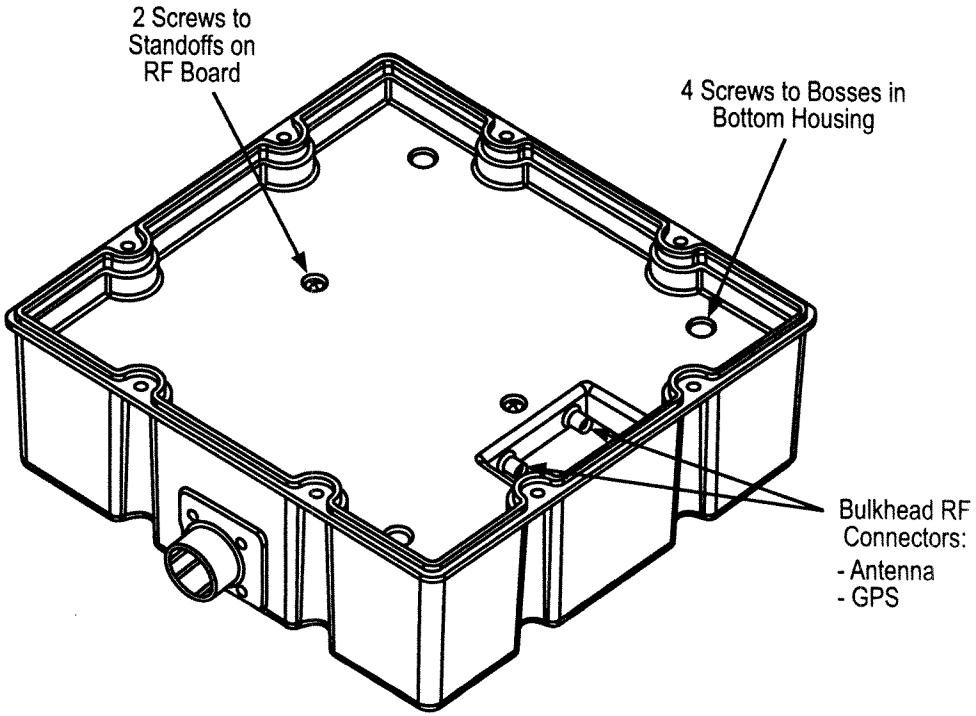
Figure 6E:
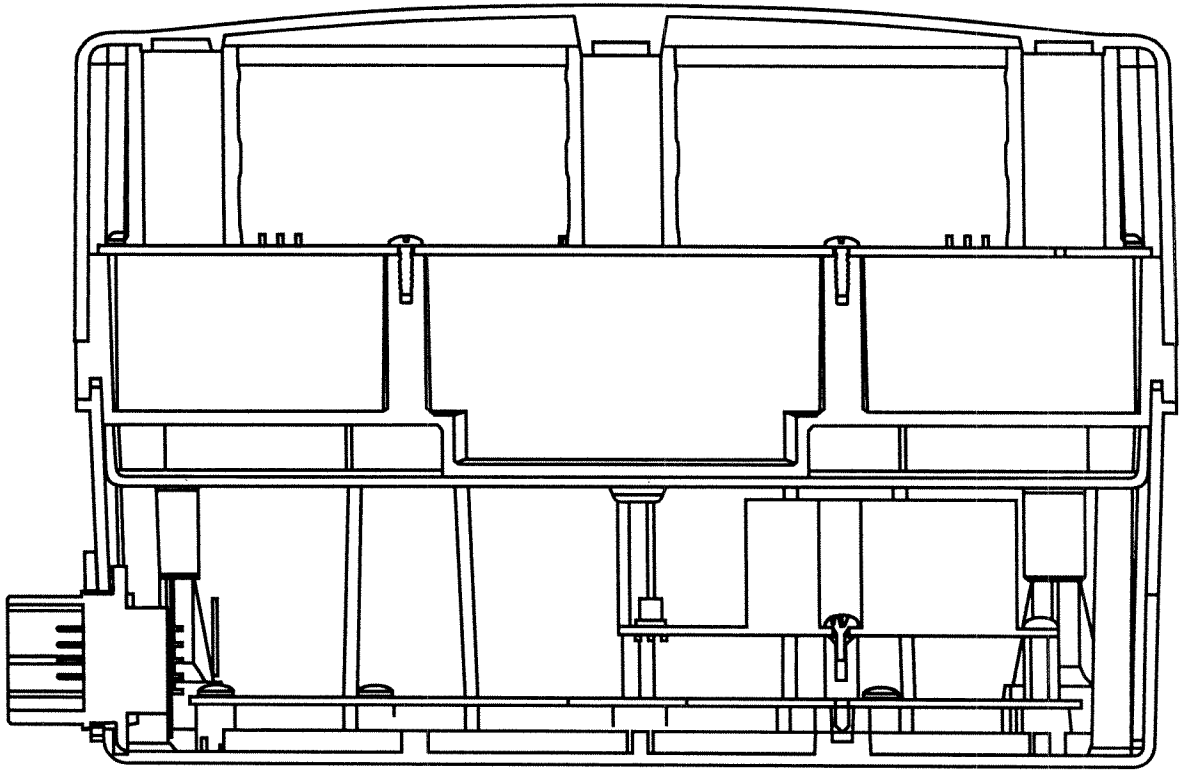

FIGS. 6A-6E illustrate the physical configuration of an exemplary embodiment of the advanced software definable radio. FIG. 6A illustrates the ASDR outer enclosure. As shown in FIG. 6A, the ASDR enclosure is a modular assembly sized to match the form and fit of an MT-2011 enclosure. FIG. 6B shows the baseband board as it fits in the enclosure. As shown in FIG. 6B, the main connector and baseband board assembly are located near the bottom of the ASDR enclosure. Most baseband components are omitted for clarity, with only the one or more RF interconnections and standoffs for mounting the RF board to the baseband board shown. FIG. 6C shows the RF board assembly. In the exemplary embodiment shown, the RF board mounts above the baseband board, with standoffs for mounting the RF board to the housing cover, and connections for connecting RF, control, and data signals between the baseband board, RF board, and the antenna. The exemplary embodiment shown also includes an RF shield, with most RF board components not shown as they are under the RF shield. Next, as shown in FIG. 6D, a housing cover mounts above the RF board. In this embodiment, the housing cover includes a recessed area for attaching a GPS module to the ASDR, with bulkhead connectors in the housing cover for connecting the GPS unit to the ASDR. Next, an antenna board mounts to the housing cover. An exemplary embodiment of an ASDR antenna may have antenna elements. A radome cover may be placed over the top of these antenna elements to complete the ASDR enclosure. A by-layer cross sectional view of the enclosure is shown in FIG. 6E. The embodiment shown in FIGS. 6A-6E is exemplary only, and not limited to what is shown. Other component arrangements may be implemented without departing from the scope of the invention.

D. Signal Processing of the HCW

Figure 7:
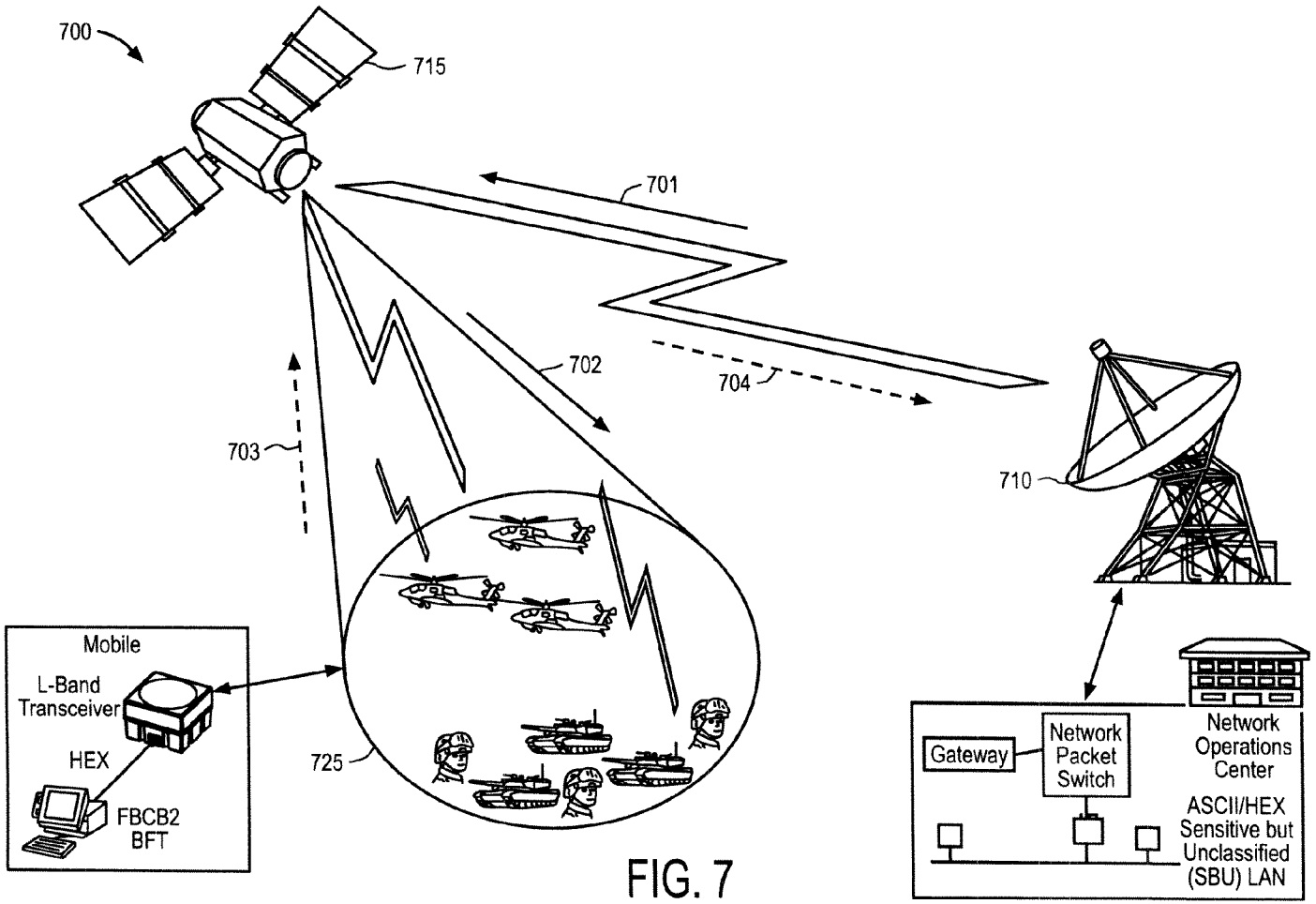
FIG. 7 illustrates use of the HCW in exemplary forward link communications between single-point and multi-point topology, and reverse link communications between multi-point topology and a single-point.

FIG. 7 illustrates use of the HCW in exemplary 700 forward link communications between single-point and multi-point topology, and reverse link communications between multi-point topology and a single-point. The forward link communications occur through transmissions of a HCW 701 from a satellite base station 710 (e.g., single-point) to a geosynchronous satellite 715, and then transmissions of a HCW 702 to a multi-point topology of users (e.g., personnel/mobile units) 725. The multi-point topology of users 725 may also communicate with the base station 710 through reverse link transmissions of a HCW 703 to a geosynchronous satellite 715, and then transmissions of a HCW 704 to the base station 710.

The signal processing method of generating the HCW 701, 702 may utilize the following signal processing components and features to support higher information data rates and robust quality of service (QOS) parameters: high level data link coding (HDLC) (802, 902), a unique packet structure assembly (806, 906), energy scrambling (803, 903), low density parity code (LDPC) forward error correction (804, 904), and root raise cosine (RRC) filtering (809, 909). The unique packet structure, illustrated with a QPSK modulated payload in FIG. 10 and with a BPSK modulated payload in FIG. 11, comprises a start-of-message preamble (SOM) (807, 907) (DBPSK modulated 911), periodic pilots (807, 907) (DBPSK modulated 911), and a payload (BPSK or QPSK modulated 905). Use of the unique packet structure allows the HCW to maintain a forward link carrier tracking of, for example, −3 dB in signal power (Es or S) below the theoretical data recovery point (e.g., Shannon-Hartley limitation on channel capacity (C) (in bps) of a bandwidth-limited channel (B) with at least some Gaussian noise (N)). The HCW supports the following user data rates (kbps) under the example conditions shown in Table 1.

TABLE 1

Operational Modes of a HCW Data Link

| Modulation Type | LDPC Code Rate | Minimum Es/N (dB) | Es/N with implementation margin (dB) | Es/N for Acq. (dB) | C/N 0 (dB) | User Throughput (kbps) |
|---|---|---|---|---|---|---|
| QPSK | 0.9 | 6.45 | 8.0 | 5.0 | 59.7 | 232.2 |
| QPSK | 0.5 | 1.50 | 3.0 | 0.0 | 54.8 | 129.0 |
| QPSK | 0.4 | 0.3 | 1.8 | −1.2 | 53.6 | 103.2 |
| BPSK | 0.9 | 3.44 | 4.9 | 1.9 | 56.7 | 116.1 |
| BPSK | 0.5 | −1.51 | 0.0 | −3.0 | 51.8 | 64.5 |
| BPSK | 0.4 | −2.7 | −1.2 | −4.2 | 50.6 | 51.6 |

Therefore, for example, users 725 requiring a satellite-based forward link 701, 702 communications capabilities with a minimum of 128 kbps of continuous data transfer and robust levels of QOS may utilize the HCW, and its unique frame structure and modulation methods, to satisfy such requirements.

1. Modulation

Figure 8:
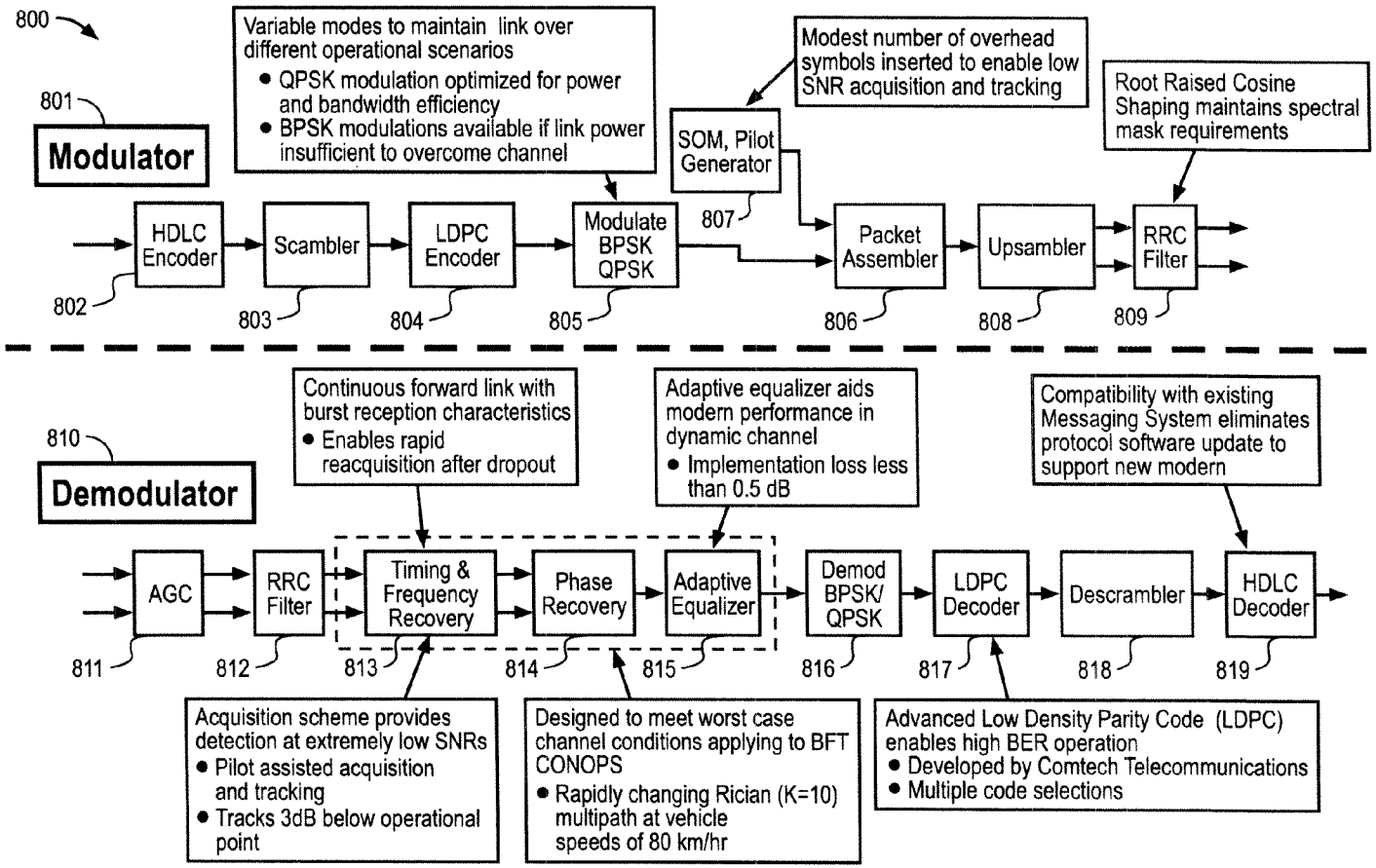
FIG. 8 illustrates an exemplary block diagram of the steps of modulating and demodulating the HCW.
Figure 9:
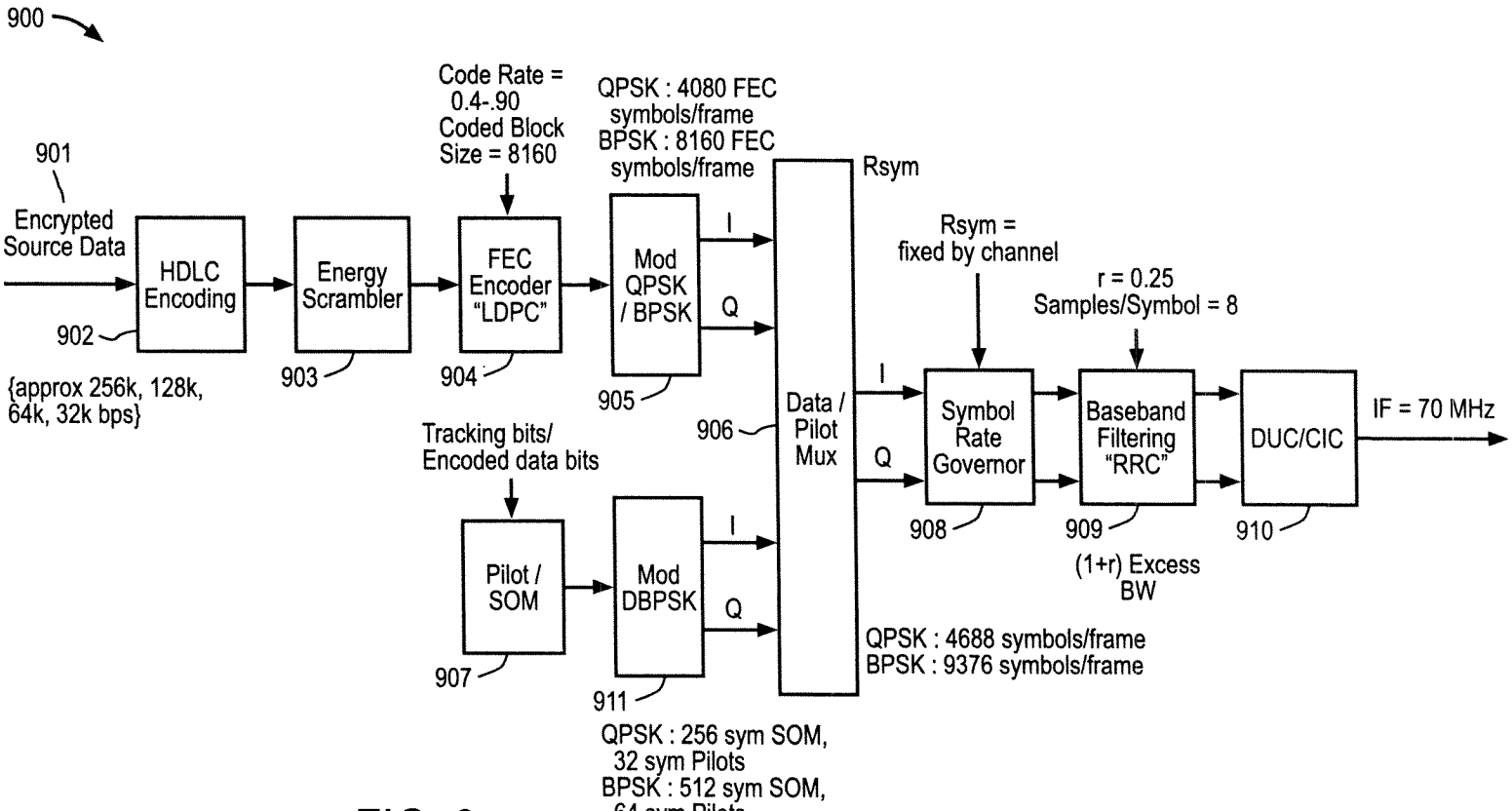
FIG. 9 illustrates an exemplary block diagram of the components and parameters for modulating the HCW.

FIG. 8 illustrates an exemplary block diagram 800 of the steps of modulating 801 and demodulating 810 the HCW. FIG. 9 illustrates an exemplary block diagram 900 of the components and parameters for modulating the HCW. The first step 1301 (FIG. 13) comprises receiving an encrypted source data packet of data as an encrypted source data signal 1302 (901) at the HDLC encoder 802, 902. The second step comprises modulating the received encrypted source data signal 1303 by encoding HDLC 1304, scrambling the modulated signal by applying digital logic 1305, and encoding the scrambled signal by a LDPC (e.g., variable rate) for FEC 1306. At step 1304, HDLC (802, 902), the HDLC encoder block enforces a protocol that demarcates packet boundaries. A bit stuffing scheme is used to ensure that a sequence such as, for example, "01111110" only occurs at the boundaries between packets. A transmitter is invoked if five consecutive zeros appear in the encrypted source data 801, 901, and the transmitter then inputs a zero. At step 1305, an energy scrambler 803, 903 is used to prevent long strings of ones and zeros in the data signal output from the HDLC 802, 902. The scrambler 803, 903 operates by performing an XOR digital logic operation on the data signal output from the HDLC 802, 902 and a random pattern, which is generated using a linear feedback shift register (LFSR) according to a polynomial such as, for example, $(x^{10}+x^3+1)$. At the start of each frame, the LFSR may be initialized to zero. The randomized data signal that results from scrambling ensures that the transmit spectrum can meet a spectral mask.

At step 1306, after processing by the HDLC (802, 902), the scrambler (803, 903) and LFSR, the scrambled signal may be assembled into a unique packet structure (806, 906). Assembly at step 1306 may involve encoding the scrambled signal by using a LDPC for FEC (804, 904). An exemplary set of coding rates, input bits, and outputs bits is provided in Table 2. Other coding rates, input bits, and output bits may be supported and implemented without departing from the scope of the invention.

TABLE 2

LDPC Encoder Coding Rates

| Code Rate | Input Bits | Output Bits |
|---|---|---|
| 0.4 | 3288 | 8160 |
| 0.5 | 4080 | 8160 |
| 0.9 | 7344 | 8160 |

Continuous transmissions over the forward link 101, 102 are packetized into frames (906 and at step 1309) that include overhead for signal acquisition. For example, for the HCW modem, two packet structures may be used. The first packet structure may be nominal (QPSK modulated payload), whereas the second packet structure may be long (BPSK modulated payload).

Figure 10:
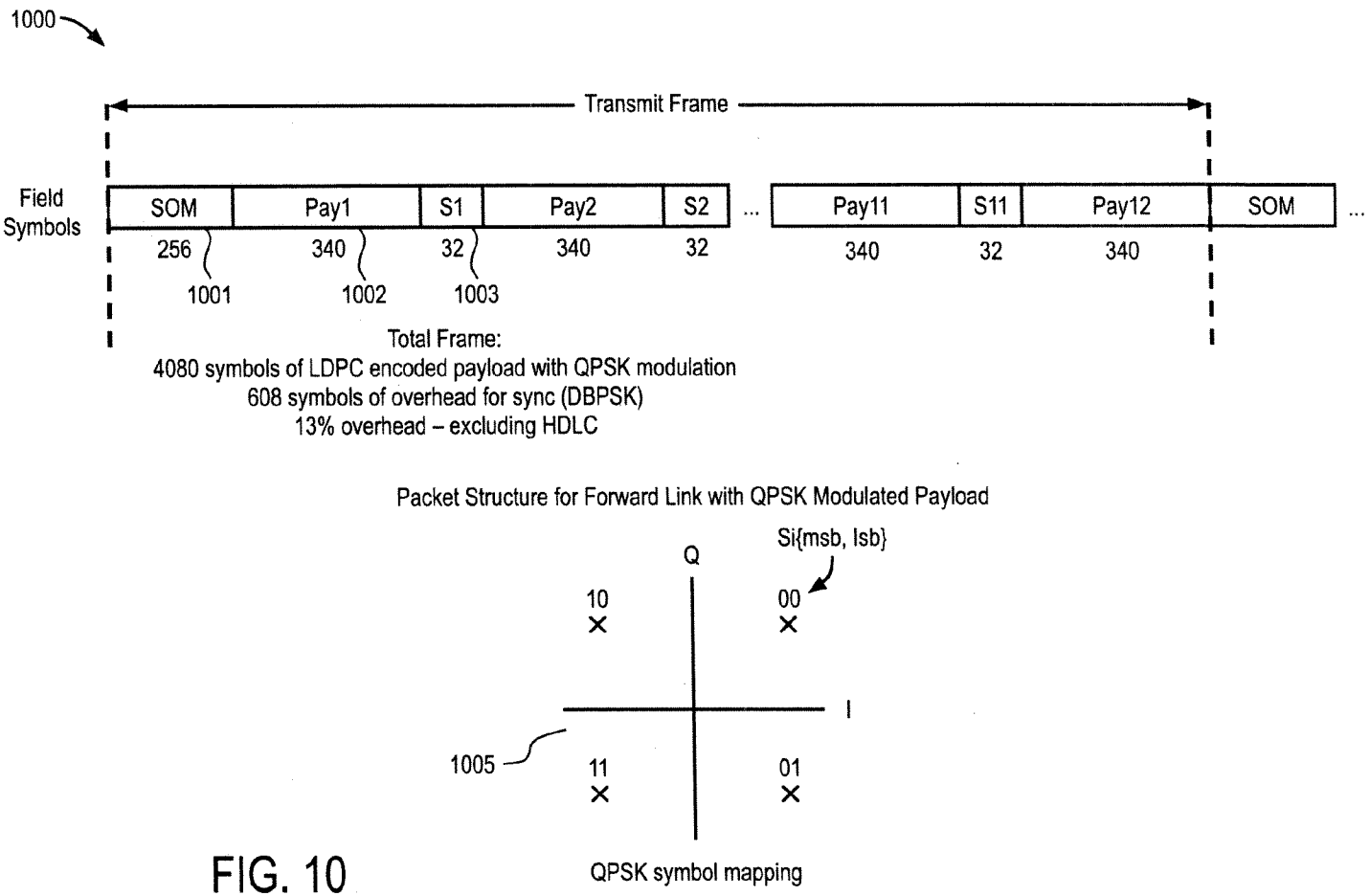
FIG. 10 illustrates an exemplary nominal packet structure for forward link with a QPSK modulated payload.

FIG. 10 illustrates an exemplary nominal packet structure 1000 for forward link with a QPSK modulated 905, 1005 (at step 1307) payload. For QPSK modulation 1307, the first FEC bit out is mapped to the lowest significant bit (LSB) of the first symbol out, and the second FEC bit out is mapped to the most significant bit (MSB) of the first symbol out. As for the nominal packet structure, each packet may contain an LDPC block of 8160 payload bits, corresponding to the block size for all three exemplary code rates described in Table 2. The exemplary nominal packet structure 1000, which may be used when the base station 710 modem is operating in a QPSK mode, comprises start of message (SOM) fields 1001 (of, for example, 256 symbols), payload fields 1002 (of, for example, 340 symbols), and pilot (S1) fields 1003 (of, for example, 32 symbols). The exemplary nominal packet structure 1000 may have 8160 payload bits in total, modulated 905 into 4080 symbols. The symbols may be broken into, for example, twelve (12) payload fields of 340 symbols each. Furthermore, for example, eleven (11) pilot fields 1003 of thirty-two (32) symbols each may be inserted between the twelve (12) payload fields 1002 (at step 1309). The SOM field 1001 may mark the start of the frame and, along with the pilots 1003, may be modulated with DBPSK 911 (at steps 1308, 1309). Thus, the total frame overhead may be, for example, equal to 608 symbols (=256+32*11) of a total frame length of 4688 symbols (multiplexed 906 according to frame structures), resulting in a total frame overhead of approximately 13%, excluding HDLC. An advantage, for example, of modulating the SOM field 1001 using DBPSK 911, and not only using QPSK like for the payload fields 1002, may be to be able to recover the data (e.g., corresponding signal) at a lower power level (e.g., −3 dB) than that otherwise required theoretically (e.g., Shannon-Hartley limitation) for recovering valid data. Such an advantage may lead to, for example, power efficiency and receiver sensitivity, which may contribute to lower latency time during data recovery (e.g., less than or equal to 4 ms). Moreover, operating within the theoretical limitations imposed by, for example, a channel capacity, may also contribute to decreased data loss and, thus, a higher QOS. Other advantages may also be realized through practice of the invention without departing from the scope of the invention as described and broadly claimed.

Figure 11:
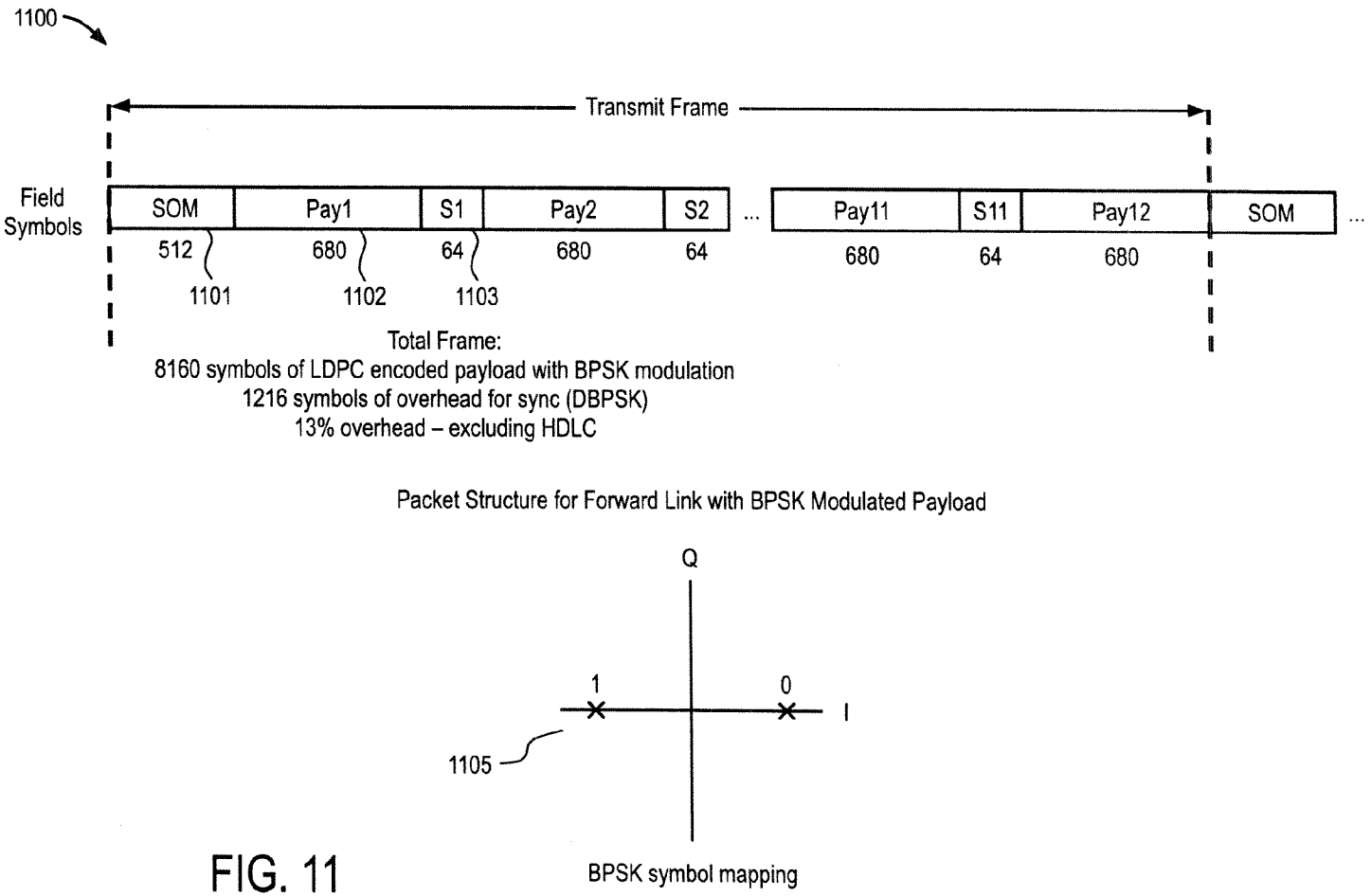
FIG. 11 illustrates an exemplary long packet structure for forward link with a BPSK modulated payload.

FIG. 11 illustrates an exemplary long packet structure for forward link with a BPSK modulated 905, 1105 (at step 1307) payload. For BPSK modulation 1307, the first FEC bit out is mapped to the first symbol out. As for the long packet structure, each packet may contain an LDPC block of 8160 payload bits, corresponding to the block size for all three exemplary code rates described in Table 2. The exemplary long packet structure 1100, which may be used when the base station 710 modem is operating in a BPSK mode, comprises start of message (SOM) fields 1101 (of, for example, 256 symbols), payload fields 1102 (of, for example, 340 symbols), and pilot (S1) fields 1103 (of, for example, 32 symbols). The exemplary long packet structure 1100 may have 8160 payload bits in total, modulated 905 into 8160 symbols. The symbols may be broken into, for example, twelve (12) payload fields of 680 symbols each. Furthermore, for example, eleven (11) pilot fields 1103 of sixty-four (64) symbols each may be inserted between the twelve (12) payload fields 1102 (at step 1309). The SOM field 1101 may mark the start of the frame and, along with the pilots 1103, may be modulated with DBPSK 911 (at steps 1308, 1309). Thus, the total frame overhead may be, for example, equal to 1216 symbols (=512+64*11) of a total frame length of 9376 symbols (multiplexed 906 according to frame structures), resulting in a total frame overhead of approximately 13%, excluding HDLC.

After step 1309, a symbol rate governor 908, which defines the master clock at a frequency, sets the rate at which data is retrieved from upstream blocks. In accordance with the frequency, downstream processing blocks are pushed.

At step 1310, a root raised cosine filter (RRC) 809, 909 may be used for pulse shaping. The RRC 809, 909 may be used to eliminate and minimize the amount of intersymbol interference (ISI) that the signal is exposed to. As is typical of Nyquist filters, the transmitting RRC filter's, ISI, when combined with a receiving RRC filter, results in a raised cosine pulse shape without ISI. Furthermore, for example, the shaping factor (beta) of the RRC may be set to 0.25.

At step 1311, which may be the final signal processing step prior to the forward link transmission from the base station, a digital upconversion 910 may convert the RRC shaped, modulated data stream from a baseband signal to an analog signal. The analog signal may be upconverted to an intermediate frequency (IF) signal of, for example, 70 MHz. Other IF frequencies may also be used without departing from the scope of the present invention. Prior to satellite transmission, the IF signal may be upconverted to a C-band signal. Then, the C-band signal may be translated to an L-band signal, and channelization filtering may be applied to the L-band signal.

2. Demodulation

Figure 12:
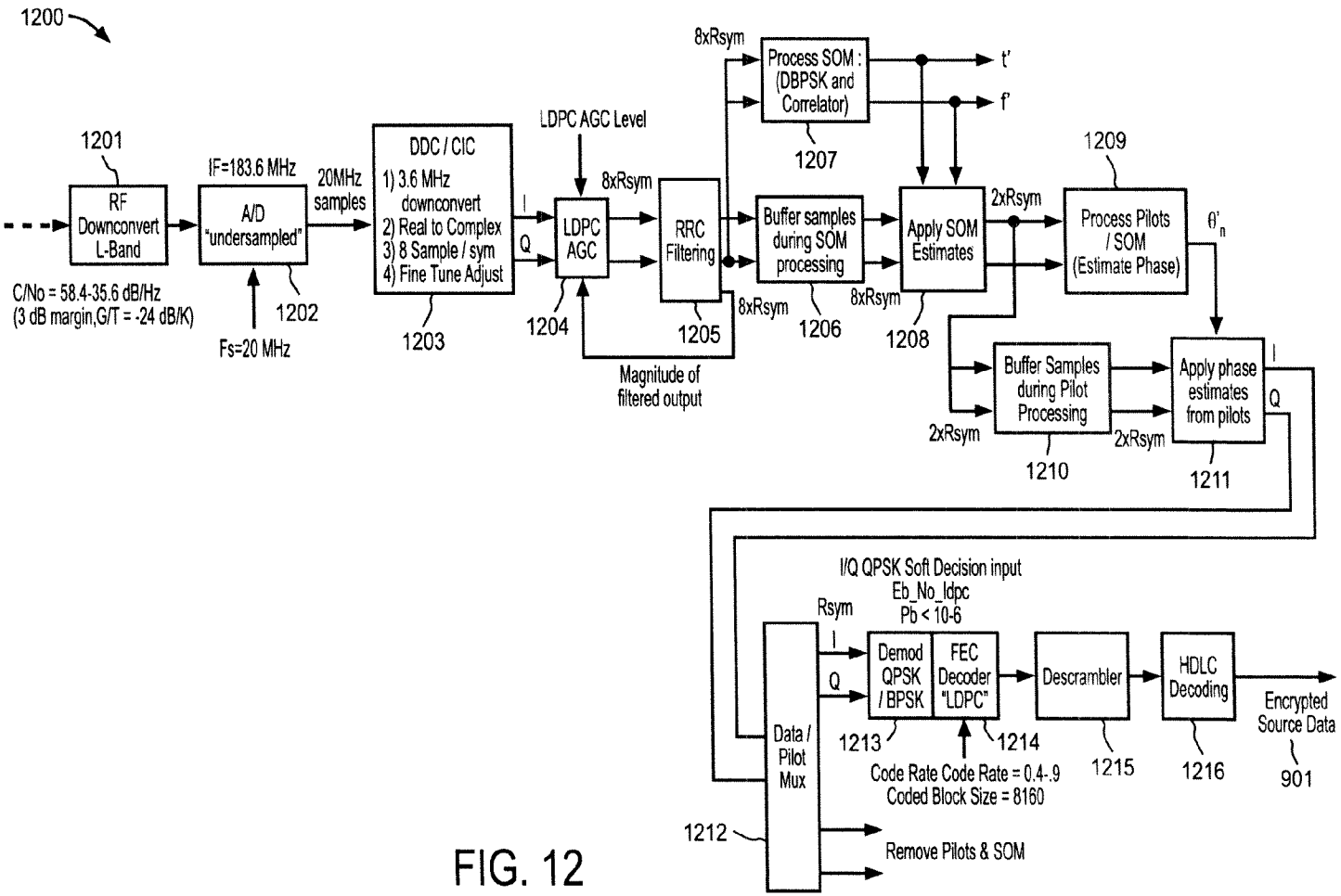
FIG. 12 illustrates an exemplary block diagram of the components for demodulating the HCW.

FIG. 12 illustrates an exemplary block diagram 1200 of the components for demodulating the HCW. The exemplary demodulation components 1201-1216 may be invoked upon receipt of a HCW signal by one or more users' 725 communication devices on the multi-point topology side, during forward link 701, 702 communications. The received HCW forward link signal 702 is first down-converted from an L-Band signal to an IF signal at a frequency such as, for example, 183.6 MHz. The A/D converter 1202 may be located on a baseband processing board and may, for example, undersample a 183.6 MHz analog IF signal at a frequency of 20 MHz and a 14 bit resolution. Then, a digital down-converter (DDC) 1203 may convert the digital signal that is output from the A/D converter 1202, and may be centered at 3.6 MHz IF, to a baseband complex signal that may be centered at a frequency of 0 MHz. The DDC may also, in addition to down-conversion, decimate the digital signal to a lower sampling rate (e.g., 8 samples/symbol). For example, the DDC may down-convert a 3.6 MHz IF centered digital signal to baseband and may, further, decimate the a sampling rate as may be required (e.g., a decimation factor may be, for example, [20 MHz/150.6 KHz]*⅛~=16.6). Down-conversion to baseband may be performed by removing digital signal samples output from the A/D. The DDC produces a complex sinusoidal signal (e.g., I and Q) that represent the baseband waveform. After down-conversion using the DDC 1203, the pair of signals may be output to an automatic gain control (AGC) 1204 and filtered by an RRC filter 1205. The conditioned samples are passed to the frequency 1211, phase 1209 and timing 1207 recover blocks. The frequency, phase and timing corrected samples are passed to the demodulator 1213 which produces soft decision quantized samples for input to the LDPC decoder 1214 (e.g., Comtech AHA LDPC). The demodulator scaled output signals conform to constellation points (e.g., I=32.0 and Q=+/−32.0). The demodulator has gain control capability which provides output levels with an average energy according to the formula: $sqrt(I^2+Q^2)$. The demodulator further formats and outputs the received samples in the form of gray-mapped BPSK symbols. The LDCP decoder 1214 may decode all valid blocks of frame data and output its best attempt of the "corrected" data to the descrambler 1215. The decoder 1214 may disregard frame data and restart the frame decoding if, for example, the frame start timing is determined to be invalid. The decoder 1214, which may be controlled by a control processor register, may be set to iterate on the frame data up to a specific number of times (e.g., 50 iterations) and may also be reset. The decoder 1214 may also have associated constraints such as, for example, a fixed code block length of 8160 bits, three selectable code rates (e.g., 0.4, 0.5, or 0.9) set by the user 725 upon system initialization. The corrected decoder output samples are passed to the HDLC decoder 1216 from reversal of the HDLC encoding process.

After signal level correction using the LDPC AGC 1204, the output signals are received by an RRC filter 1205 for pulse shaping that matches the RRC filter 909 on the transmitting end of the forward link communication 701, 702. After the RRC filter 1205 performs its pulse shaping, a raised cosine pulse shape is produced that serves to minimize and eliminate ISI.

After the RRC filter 1205 has produced a raised cosine pulse shape with minimized/eliminated ISI, SOM processing may proceed using a differential detector 1207 to demodulate the DBPSK encoded SOM field (e.g., at 8 samples per symbol) of the frame being processed. As a result of SOM processing, time, frequency, and initial phase estimation of the received frame may be achieved. The output of the differential detector 1207 is then passed to a correlator 1207, and when the output of the correlator 1207 exceeds a threshold, the SOM is detected. After the SOM is detected, frequency estimation may be performed by a frequency estimator. Prior to passing the signal through the frequency estimator, the known SOM modulation is multiplied by its complex conjugate to produce a frequency error metric. The residual phase of the sequence may be analyzed to create a frequency estimate 1208, which may be formed by combining the output of two cascaded frequency estimators. For example, the combined performance of the two frequency estimators may provide an estimate that is within 25 Hz for a 256 symbol SOM (e.g., the nominal packet structure 1000) and within 10 Hz for a 512 symbol SOM (e.g., the long packet structure 1100). An NCO may then remove the frequency estimate from the data stream.

After SOM processing 1206 and frequency estimation 1208, and with the frequency estimate removed from the data stream, pilot/SOM phase estimation 1209 may be computed by removing the known modulation sequence on the SOM, summing the 256/512 symbols of the nominal/long packet structure in the SOM, and using a CORDIC algorithm to compute the phase angle. Linear interpolation may be used between consecutive phase estimates to arrive at a phase correction that may be applied 1211 to each symbol in the payload. The first payload section linear interpolation may occur between the SOM and the first pilot. The last payload section linear interpolation may occur between the last pilot and the SOM on the next message. Samples may be buffered during pilot processing 1210 to prevent loss of information while frequency, phase and timing are being determined.

After phase estimation 1211, a data/pilot multiplexer 1212 may remove the SOM and pilots from the received data stream such that only payload symbols are passed to the LDPC FEC decoder 1214. In addition, a QPSK/BPSK demodulator 1213 may analyze the payload symbols such that diagnostic information on the raw bit error rate (BER) into the LDPC FEC decoder 1214 may be calculated during built in test mode. Soft metrics may be passed through to the LDPC FEC decoder 1214, and the input and output of the LDPC FEC decoder 1214 may be compared to form a BER estimate. The LDPC FEC decoder 1214 may iterate over all received payload samples to produce an error corrected output data stream. The decoder 1214 may have a fixed code block length of 8160 bits, three selectable data rates (e.g., 0.4, 0.5, or 0.9) set by a user 725, a selectable number of iterations to execute on each FEC block, gain control capability providing the input levels/signals with an average energy according to the formula: $sqrt(I^2+Q^2)$, the ability to receive input signals in the form of gray-mapped QPSK symbols, and the ability to operate at a frequency such as 100 MHz.

The output of the decoder 1214 may be then received by a descrambler 1215. The descrambler 1215 may undo the scrambling 903 performed at the modulator. An LFSR similar to what is used at the modulator may be used. Such an LFSR may be initialized to all zeros at the beginning of each frame.

After the descrambler 1215 has undone the scrambling 903 performed at the modulator, the output of the descrambler may be then received by an HDLC decoder 1216. The HDLC decoder 1216 may undo the bit stuffing operation performed at the modulator. The HDLC decoder 1216 may read the input data stream and detect five consecutive 1's in the data stream. Then, the HDLC decoder may delete the next bit after a detection of five consecutive 1's, if the next bit is a zero. If the HDLC decoder detects the next bit to be a 1, however, it may recognize the special framing pattern and output the original encrypted source data signal 901.

Figure 13:
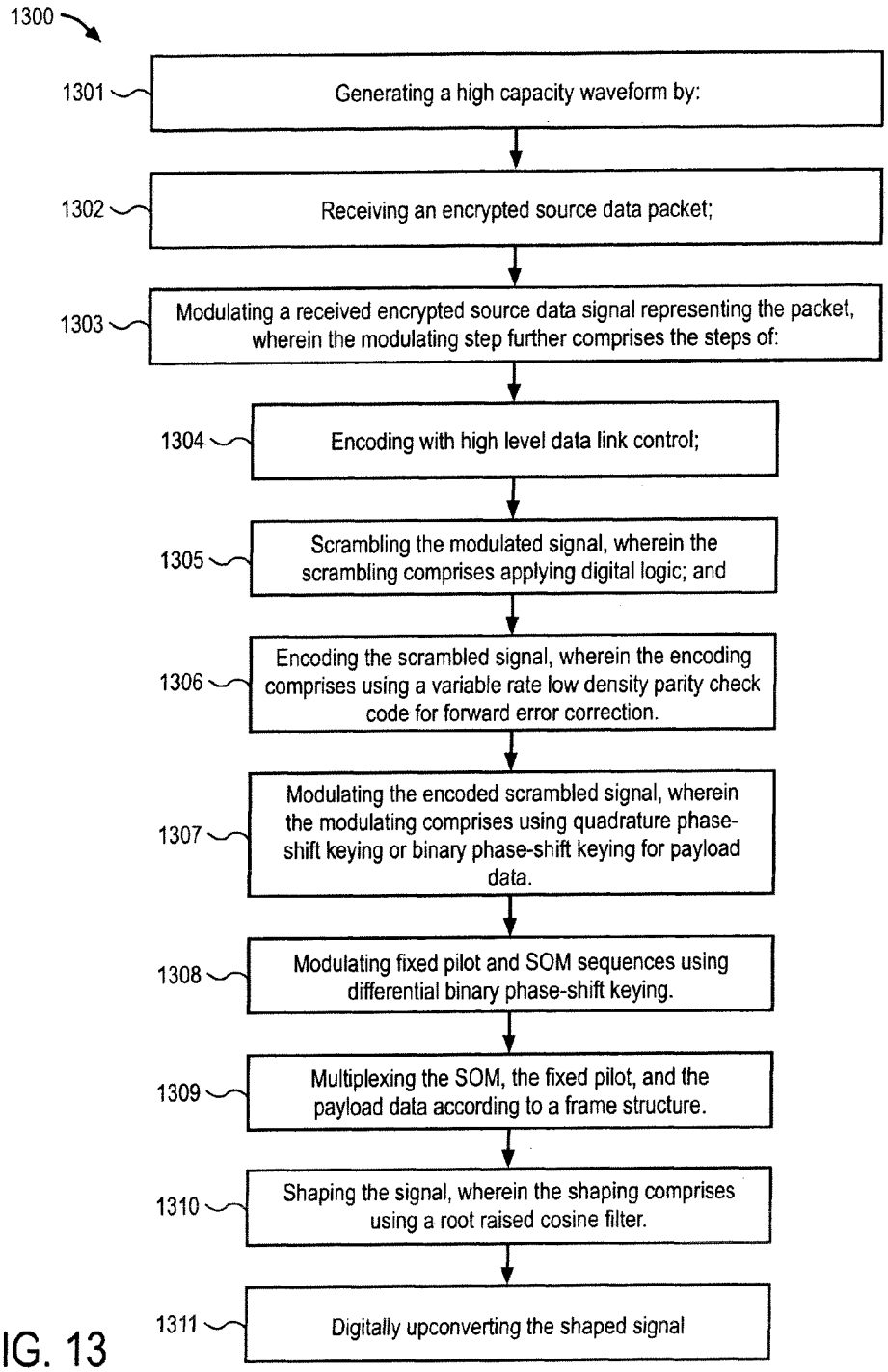
FIG. 13 illustrates an exemplary method for generating a HCW.

FIG. 13 illustrates an exemplary method 1300 for generating a HCW 1301. The steps 1301-1311 are discussed above in detail.

It will be apparent to those skilled in the art that various modifications and variations may be made to signal processing of a HCW without departing from the spirit or scope of the invention. Thus, it is intended that the present invention cover the modifications and variations of this invention provided they come within the scope of the appended claims and their equivalents.

We claim:

1. A method of generating a high capacity waveform with one or more frames, comprising:

at an electronic device with one or more processors and memory:

receiving encrypted source data;

generating a payload for a respective frame of the high capacity waveform, including:

encoding a portion of the encrypted source data with high level data link control (HDLC);

after encoding the portion of the encrypted source data with HDLC, scrambling the portion of the encrypted source data;

after scrambling the portion of the encrypted source data, encoding the portion of the encrypted source data with a variable rate low density parity check (LDPC) code for forward error correction; and after encoding the portion of the encrypted source data with LDPC code, modulating the portion of the encrypted source data with a first modulation protocol;

generating one or more pilot and header sequences for the respective frame of the high capacity waveform, including:

modulating the one or more pilot and header sequences with a second modulation protocol different from the first modulation protocol; and after generating the payload and the one or more pilot and header sequences, generating the respective frame by multiplexing the generated payload and the generated one or more pilot and header sequences.

2. The method of claim 1, including, shaping the respective frame, wherein the shaping comprises using a root raised cosine filter.

3. The method of claim 2, including, digitally upconverting the shaped respective frame.

4. The method of claim 3, including, converting the digitally upconverted respective frame to an analog respective frame.

5. The method of claim 4, including, upconverting the analog respective frame to an intermediate frequency (IF) respective frame.

6. The method of claim 5, including, upconverting the IF respective frame to a C-band respective frame for satellite transmission.

7. The method of claim 6, including, translating the C-band respective frame to an L-band respective frame.

8. The method of claim 7, including, applying channelization filtering to the L-band respective frame.

9. A non-transitory computer-readable storage medium having stored thereon computer-executable instructions that, when executed by one or more processors of an electronic device, cause the device to:

receive encrypted source data;

generate a payload for a respective frame of the high capacity waveform, including:

encoding a portion of the encrypted source data with high level data link control (HDLC);

after encoding the portion of the encrypted source data with HDLC, scrambling the portion of the encrypted source data;

after scrambling the portion of the encrypted source data, encoding the portion of the encrypted source data with a variable rate low density parity check (LDPC) code for forward error correction; and after encoding the portion of the encrypted source data with LDPC code, modulating the portion of the encrypted source data with a first modulation protocol;

generate one or more pilot and header sequences for the respective frame of the high capacity waveform, including:

modulating the one or more pilot and header sequences with a second modulation protocol different from the first modulation protocol; and after generating the payload and the one or more pilot and header sequences, generate the respective frame by multiplexing the generated payload and the generated one or more pilot and header sequences.

10. An electronic device, comprising:

one or more processors; and memory storing one or more programs to be executed by the one or more processors, the one or more programs comprising instructions for:

receiving encrypted source data;

generating a payload for a respective frame of the high capacity waveform, including:

encoding a portion of the encrypted source data with high level data link control (HDLC);

after encoding the portion of the encrypted source data with HDLC, scrambling the portion of the encrypted source data;

after scrambling the portion of the encrypted source data, encoding the portion of the encrypted source data with a variable rate low density parity check (LDPC) code for forward error correction; and after encoding the portion of the encrypted source data with LDPC code, modulating the portion of the encrypted source data with a first modulation protocol;

generating one or more pilot and header sequences for the respective frame of the high capacity waveform, including:

modulating the one or more pilot and header sequences with a second modulation protocol different from the first modulation protocol; and after generating the payload and the one or more pilot and header sequences, generating the respective frame by multiplexing the generated payload and the generated one or more pilot and header sequences.

11. The method of claim 1, wherein the first modulation protocol is selected from one of quadrature phase-shift keying and binary phase-shift keying, and wherein the second modulation protocol is differential binary phase-shift keying.

12. The non-transitory computer-readable storage medium of claim 9, wherein the first modulation protocol is selected from one of quadrature phase-shift keying and binary phase-shift keying, and wherein the second modulation protocol is differential binary phase-shift keying.

13. The device of claim 10, wherein the first modulation protocol is selected from one of quadrature phase-shift keying and binary phase-shift keying, and wherein the second modulation protocol is differential binary phase-shift keying.

* * * * *